US011554588B2

(12) United States Patent
Ueda et al.

(10) Patent No.: US 11,554,588 B2
(45) Date of Patent: Jan. 17, 2023

(54) INKJET RECORDING APPARATUS

(71) Applicant: KYOCERA Document Solutions Inc., Osaka (JP)

(72) Inventors: Hiroyuki Ueda, Osaka (JP); Chikara Ishihara, Osaka (JP); Takashi Somete, Osaka (JP); Issei Nakano, Osaka (JP); Jun Nakano, Osaka (JP); Hiroomi Nakatsuji, Osaka (JP); Aiichiro Otana, Osaka (JP); Takuma Araki, Osaka (JP); Noriaki Furukawa, Osaka (JP); Yasutaka Inui, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 28 days.

(21) Appl. No.: 17/206,262

(22) Filed: Mar. 19, 2021

(65) Prior Publication Data

US 2021/0300045 A1 Sep. 30, 2021

(30) Foreign Application Priority Data

Mar. 25, 2020 (JP) ..... JP2020-054753

(51) Int. Cl.
*B41J 2/165* (2006.01)
*B41J 11/00* (2006.01)

(52) U.S. Cl.
CPC ..... *B41J 2/16535* (2013.01); *B41J 2/16523* (2013.01); *B41J 11/007* (2013.01)

(58) Field of Classification Search
CPC ..... B41J 2/16535
See application file for complete search history.

(56) References Cited

U.S. PATENT DOCUMENTS

| | | | | |
|---|---|---|---|---|
| 2012/0069085 | A1* | 3/2012 | Yamagishi | B41J 2/1714 347/30 |
| 2018/0154640 | A1* | 6/2018 | Furukawa | B41J 2/16552 |
| 2018/0229510 | A1* | 8/2018 | Endo | F01M 9/12 |

FOREIGN PATENT DOCUMENTS

| | | |
|---|---|---|
| JP | 2002-79680 | 3/2002 |
| JP | 2004-25488 | 1/2004 |
| JP | 2004-98477 | 4/2004 |
| JP | 2018-89829 | 6/2018 |

* cited by examiner

*Primary Examiner* — Sharon Polk
(74) *Attorney, Agent, or Firm* — Lex IP Meister, PLLC

(57) ABSTRACT

The inkjet recording apparatus includes a conveyance belt, a conveyance plate, a suction unit, an inkjet head, and a cleaning unit. The conveyance belt has a plurality of through holes. The conveyance plate includes a plurality of through holes formed in bottom portions of the plurality of recessed portions. The suction unit is configured to suck the sheet to the conveyance belt. The inkjet head includes a head main body and a head end portion adjacent to the head main body, and faces an upper surface of the conveyance plate via the conveyance belt. The cleaning unit removes ink adhering to a lower surface of the head main body. A depth of the recessed portion in a facing region facing the head end portion of the conveyance plate is shallower than a depth of the recessed portion in a region other than the facing region.

7 Claims, 22 Drawing Sheets

INKJET RECORDING APPARATUS

INCORPORATION BY REFERENCE

This application is based upon and claims the benefit of priority from the corresponding Japanese Patent Application No. 2020-054753 filed on Mar. 25, 2020, the entire contents of which are incorporated herein by reference.

FIELD

The present disclosure relates to an inkjet recording apparatus.

BACKGROUND

There is known an inkjet recording apparatus in which a sheet is sucked and conveyed by a conveyance belt, and ink is discharged onto the sheet from a line type inkjet head including a plurality of nozzles arranged in a direction intersecting with a conveyance direction. The conveyance belt is provided with a plurality of through holes, and the sheet is sucked by absorption of air from the through holes. In this method, when ink adheres to the vicinity of the nozzles, there is a concern that the discharge direction and the discharge amount of the ink may change. Therefore, a function of cleaning the lower surface of the inkjet head using a cleaning member having flexibility has been proposed.

For example, it has been proposed that a lower surface of an end portion (hereinafter, referred to as a head end portion) of the inkjet head in a direction intersecting with the conveyance direction is inclined so as to become higher as a distance from a center of the inkjet head increases, thereby making recovery of deflection of the cleaning member gentle and suppressing scattering of ink. It has been proposed to supply a cleaning liquid to the cleaning member through the holes provided on the lower surface of the head end portion.

SUMMARY

So as to solve the above-stated problem, according to the present disclosure, there is provided an inkjet recording apparatus including: an endless conveyance belt including a plurality of through holes and wound around a plurality of rollers; a conveyance plate including a plurality of recessed portions formed in an upper surface thereof and a plurality of through holes formed in bottom portions of the plurality of recessed portions, the upper surface being in contact with an inner peripheral surface of the conveyance belt; and a suction unit that sucks air from the plurality of through holes of the conveyance plate to suck a sheet to the conveyance belt. The inkjet recording apparatus also includes an inkjet head including a head main body having a lower surface on which a plurality of nozzles arranged in a width direction of the conveyance belt intersecting the conveyance direction of the conveyance belt are formed, and a head end portion adjacent to one end or both ends of the head main body in the width direction, they inkjet head facing an upper surface of the conveyance plate via the conveyance belt; and a cleaning unit that removes ink attached to a lower surface of the head main body by bringing a cleaning member into contact with the lower surface of the head main body and sliding the cleaning member in the width direction, where a depth of the recessed portion in a facing region of the conveyance plate facing the head end portion is shallower than a depth of the recessed portion in a region other than the facing region.

DETAILED DESCRIPTION

Hereinafter, a printer 1 (inkjet recording apparatus) according to an embodiment of the present invention will be described with reference to the drawings.

Figure 1:
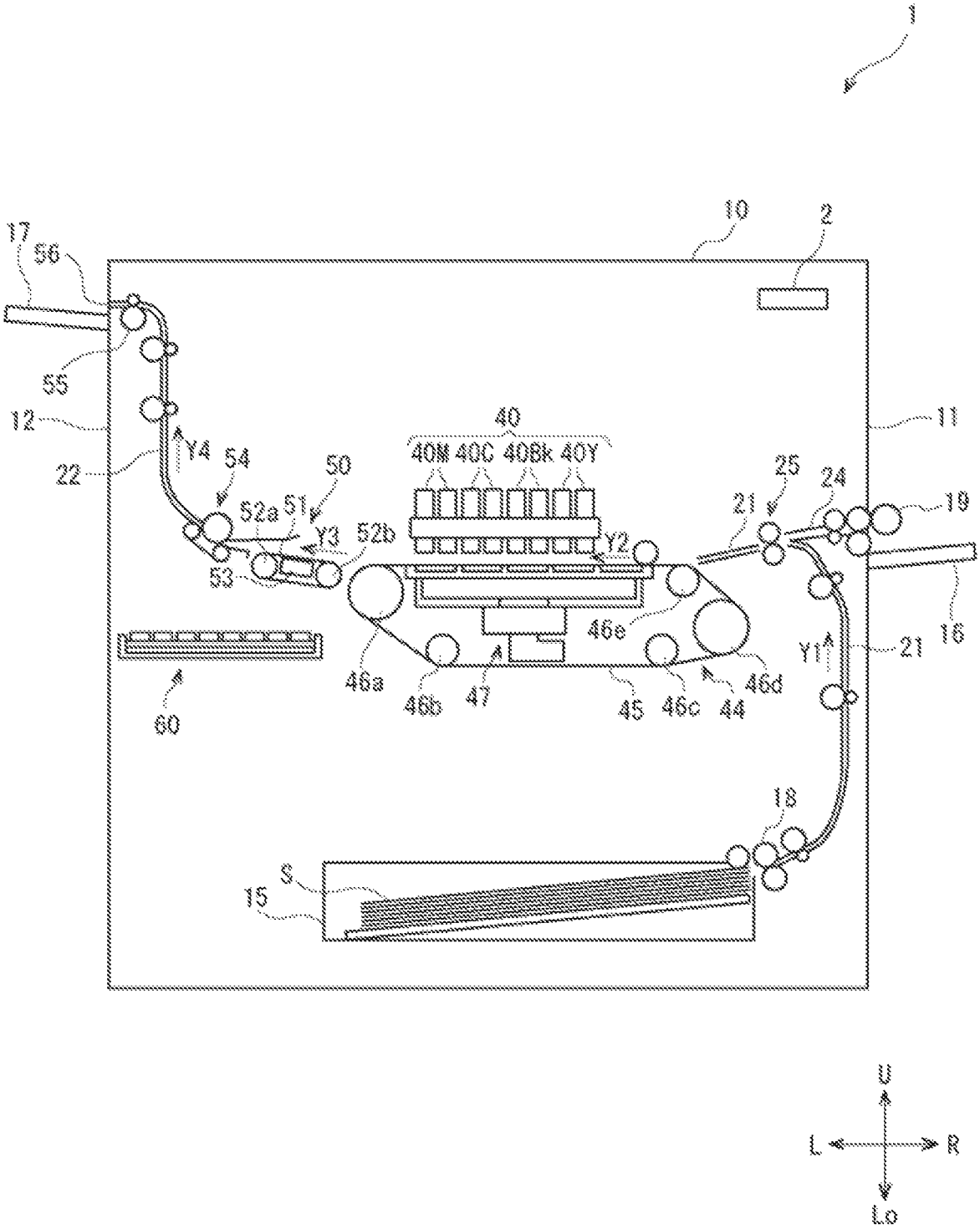
FIG. 1 is a front view schematically showing an internal configuration of a printer according to an embodiment of the present disclosure.

First, the overall configuration of the printer 1 will be described with reference to FIG. 1. FIG. 1 is a front view schematically showing an internal configuration of the printer 1. In the following description, the front side of the FIG. 1 will be referred to as the front side (front side) of the printer 1, and the left and right directions will be described with reference to the direction in which the printer 1 is viewed from the front. In each drawing, U, Lo, L, R, Fr, and Rr indicate up, down, left, right, front, and rear, respectively.

As shown in FIG. 1, the printer 1 is an inkjet type image forming apparatus that forms an image by ejecting ink onto a sheet S (plain paper, coated paper, or the like), and is capable of single-sided printing and double-sided printing on the sheet S. The printer 1 includes a box-shaped housing 10 in which various devices are accommodated. A sheet feeding cassette 15 that can be pulled out and in which the sheets S are accommodated is provided in a lower portion in the housing 10, and a manual feed tray 16 in which the sheets S are manually stacked is provided in a right side surface 11 of the housing 10. A sheet discharge tray 17 in which the sheets S having an image formed thereon are stacked is provided in an upper portion of the left side surface 12 of the housing 10, and a sheet discharge port 56 from which the sheets S are discharged is formed above the sheet discharge tray 17 on the left side surface 12.

An image forming unit 39 that forms an image on a sheet S is provided in a central portion inside the housing 10, a print conveyance unit 44 that conveys the sheet S on which an image is formed is provided below the image forming unit 39, and a drying conveyance unit 50 that dries the sheet S on which an image has been formed while conveying the sheet S is provided on the left side of the print conveyance unit 44.

A first conveyance path 21 extending from the sheet feeding cassette 15 to the print conveyance unit 44 and a manual feed conveyance path 24 extending from the manual feed tray 16 to the first conveyance path 21 are formed in a right side portion in the housing 10. A second conveyance path 22 extending from the drying conveyance unit 50 to the sheet discharge tray 17 is formed in a left side portion in the housing 10.

In the first conveyance path 21, a sheet feeding unit 18 and a pair of registration rollers 25 are provided in this order from the upstream side of the conveyance direction Y1. The sheet feeding unit 18 includes a roller to feed the sheets S accommodated in the sheet feeding cassette 15 one by one to the first conveyance path 21.

The manual feed conveyance path 24 merges with the first conveyance path 21 between the sheet feeding unit 18 and the registration roller pair 25. The manual feed unit 19 includes rollers that feed the sheets S stacked on the manual feed tray 16 one by one to the manual feed conveyance path 24.

In the image forming unit 39, line-type inkjet heads 40Y, 40Bk, 40C, and 40M that eject inks of different colors are arranged in the conveyance direction Y2 of the sheet S. On the lower surfaces of the inkjet heads 40Y, 40Bk, 40C, and 40M, a large number of nozzles 41N arranged in the width direction X of the sheet S intersecting with the conveyance direction Y2 are formed. Inkjet heads 40Y, 40Bk, 40C, and 40M are arranged in this order from the upstream side of the Y2 in the conveyance direction, and eject yellow, black, cyan, and magenta inks, respectively.

The print conveyance unit 44 includes a driving roller 46*a*, a plurality of driven rollers 46*b*, 46*c*, 46*d*, and 46*e*, and a conveyance belt 45 wound around the driving roller 46*a* The driving roller 46*a* is driven by a driving source (not shown) such as a motor, so that the conveyance belt 45 is driven in the direction. A plurality of through holes are formed in the conveyance belt 45. A suction unit 47 that generates negative pressure in the through holes of the conveyance belt 45 by sucking air is provided at a position facing the image forming unit 39 inside the conveyance belt 45.

The drying conveyance unit 50 includes a driving roller 52*a*, a driven roller 52*b*, and a conveyance belt 51 wound around the driving roller 52*a* and the driven roller 52*b*. The conveyance belt 51 is driven in the direction Y3 by driving the driving roller 52*a* by a driving source such as a motor (not shown). Many through holes are formed in the conveyance belt 51. A suction unit 53 that generates a negative pressure in the through holes of the conveyance belt 51 by sucking air is provided in an upper portion on the inner side of the conveyance belt 51.

In the second conveyance path 22, a decurling device 54 and a sheet discharge unit 55 are provided in this order from the upstream side of the conveyance direction Y4. The decurling device 54 includes a belt wound around a plurality of rollers and a roller in contact with the belt, and is driven by a drive source (not illustrated) such as a motor. The sheet discharge unit 55 includes a roller for discharging a sheet S onto the sheet discharge tray 17 from the second conveyance path 22.

Each unit of the printer 1 is controlled by a control unit 2. The control unit 2 may be realized by software using a processor, or may be realized by a logic circuit (hardware) formed in an integrated circuit or the like. In the case of using a processor, various processes are performed by the processor reading and executing a program stored in a memory. As the processor, a central processing unit (CPU) is used, for example. The memory includes a storage medium such as a read only memory (ROM), a random access memory (RAM), and an electrically erasable programmable read only memory (EEPPOM), and a control program used to control each unit of the printer 1 is stored in the memory.

Next, an outline of an image forming operation of the printer 1 will be described. When an image forming instruction is input to the printer 1, the sheet S is fed from the sheet feeding cassette 15 or the manual feed tray 16 and is conveyed in the Y1 direction along the first conveyance path 21. When the sheet S reaches the registration roller pair 25, the leading end portion (the end portion on the downstream side of the conveyance direction Y1) of the sheet S abuts against the nip region of the registration roller pair 25 that has stopped rotating, thereby correcting the skew of the sheet S, and the sheet S is sent to the print conveyance unit 44 in synchronization with the ink ejection timing of the image forming unit 39. The sheet S is attracted to the conveyance belt 45 by the negative pressure of the through holes of the conveyance belt 45, and is conveyed in the Y2 direction. Then, an image is formed on the sheet S by ejecting ink toward the sheet S from the inkjet heads 40Y, 40Bk, 40C, and 40M.

The sheet S on which the image has been formed is conveyed to the drying conveyance unit 50, is attracted to the conveyance belt 51 by the negative pressure of the through holes of the conveyance belt 51, and is conveyed in the Y3 direction, whereby the drying of the ink is promoted. Subsequently, the sheet S is conveyed to the decurling device 54, and is nipped and conveyed by the decurling device 54, whereby the curl is corrected. The sheet S is conveyed in the Y4 direction along the second conveyance path 22, and is discharged to the sheet discharge tray 17 by the sheet discharge unit 55.

Figure 2:
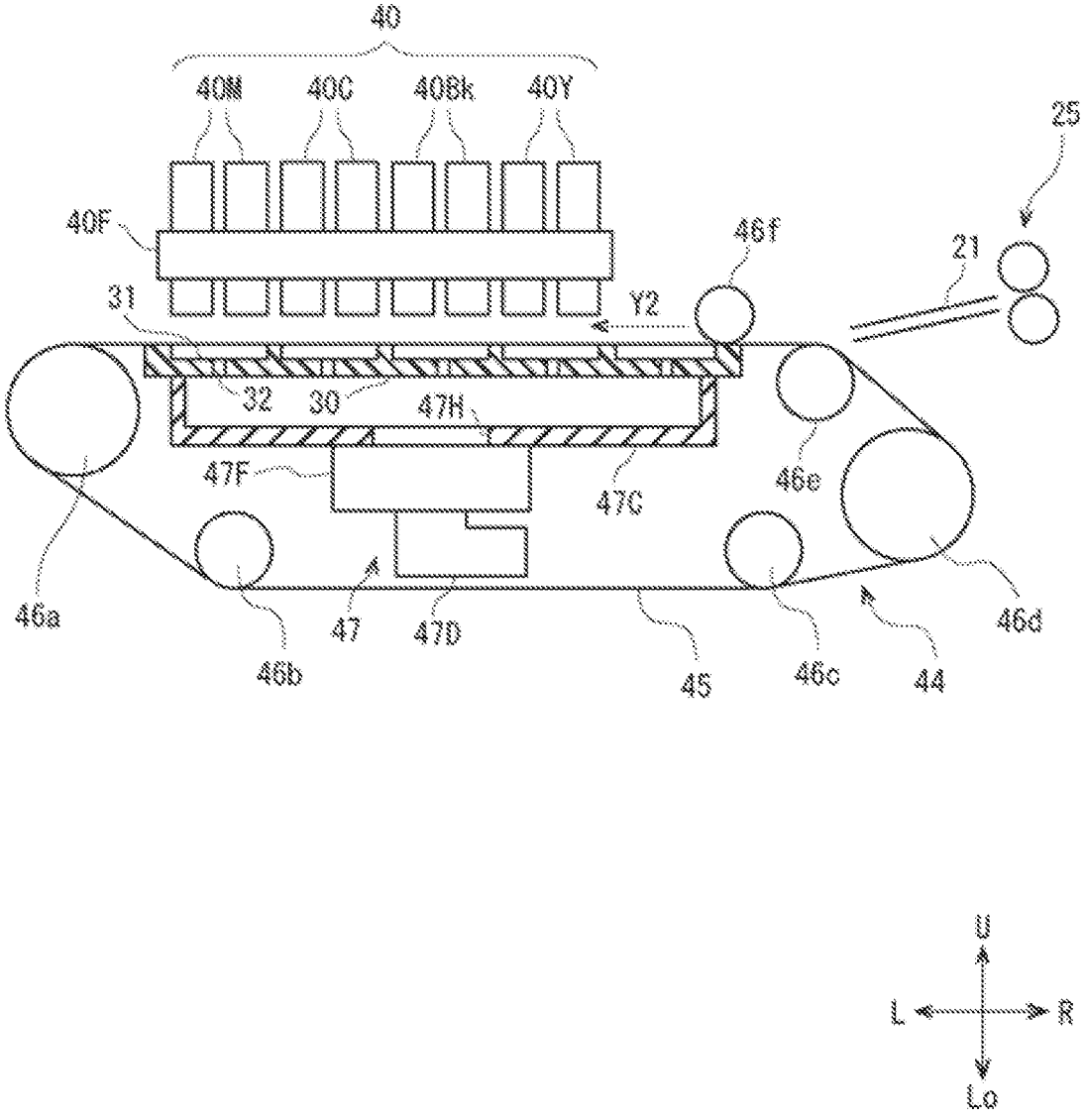
FIG. 2 is a cross-sectional view of an image forming unit and a print conveyance unit according to an embodiment of the present disclosure.
Figure 3:
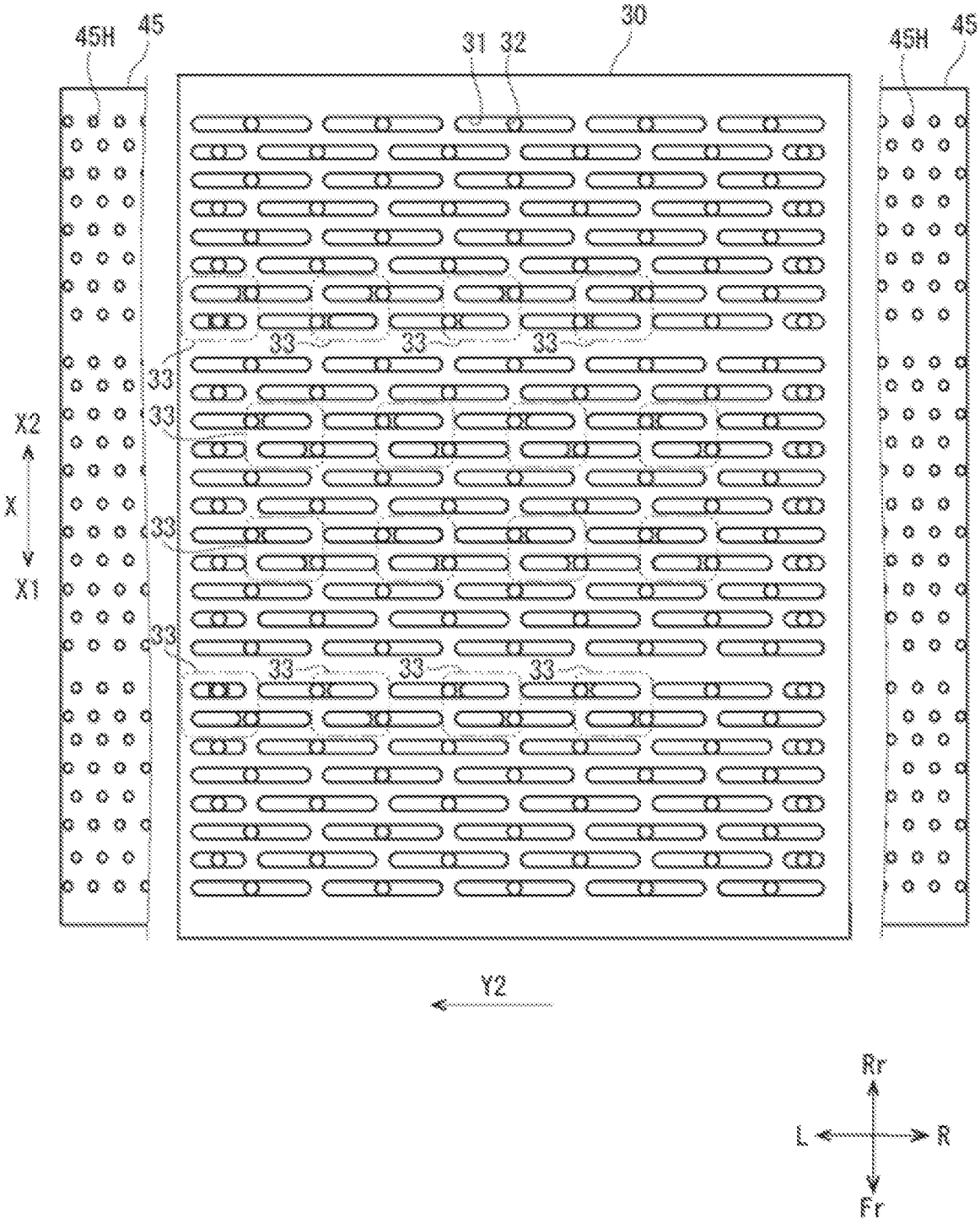
FIG. 3 is a plan view of a conveyance plate and a conveyance belt according to an embodiment of the present disclosure.
Figure 4:
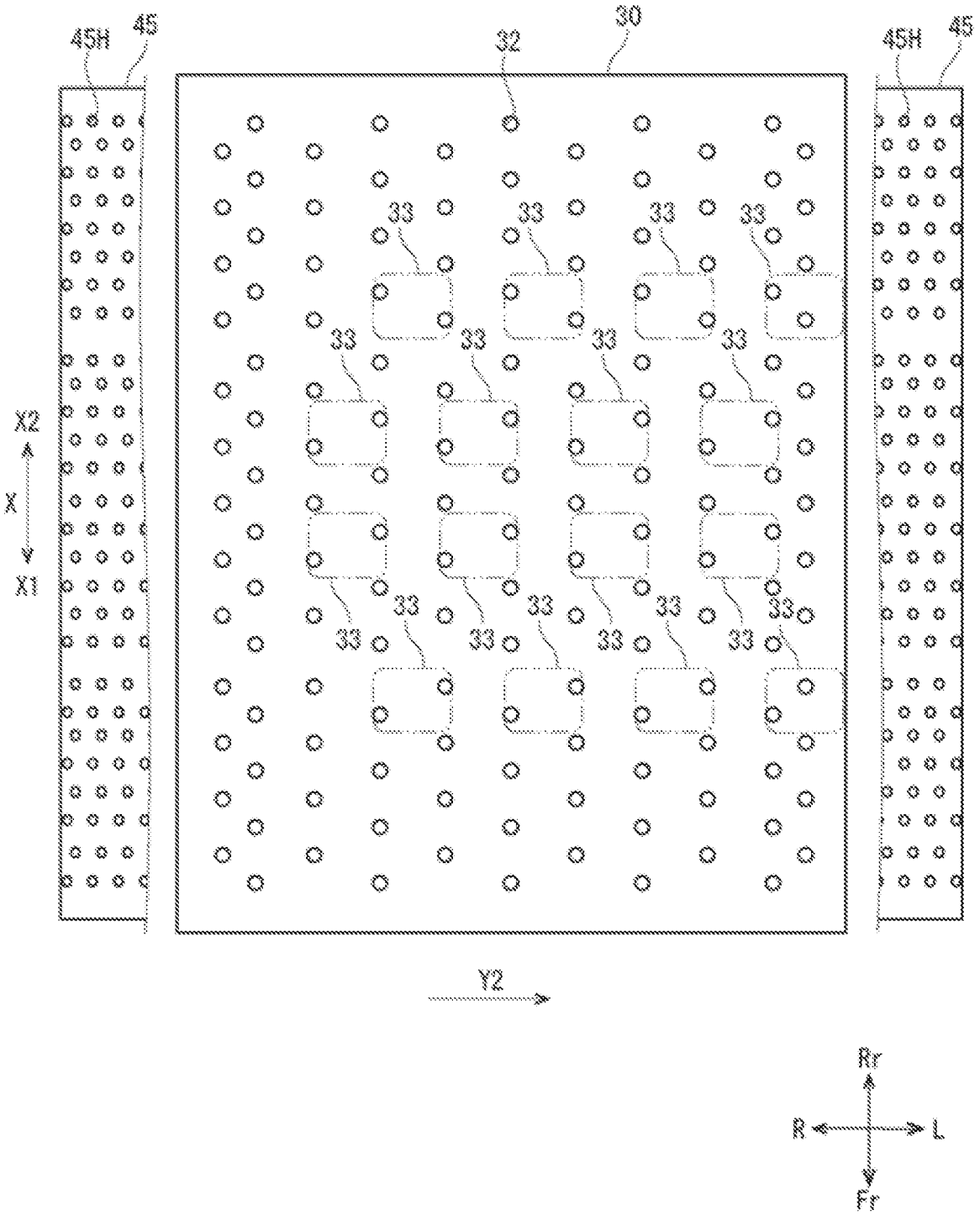
FIG. 4 is a bottom view of a conveyance plate and a conveyance belt according to an embodiment of the present disclosure.
Figure 5A:
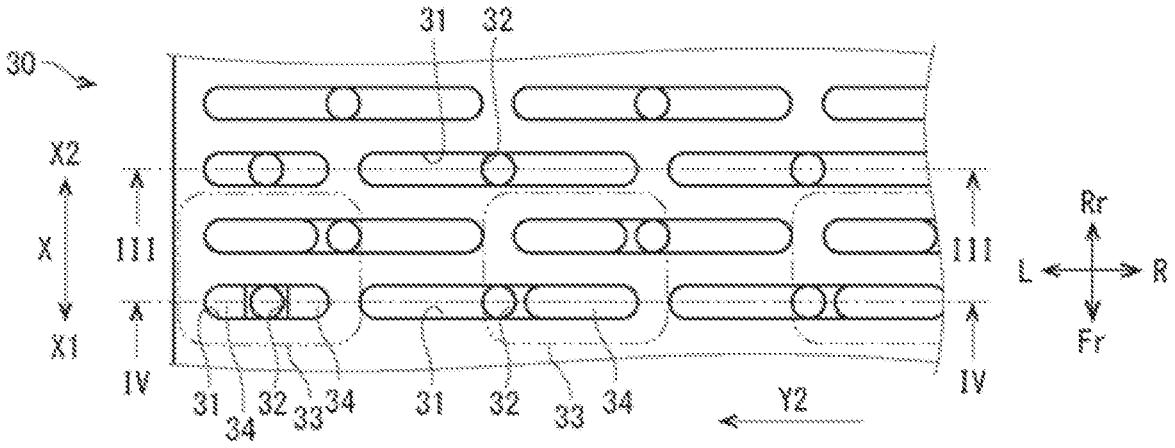
FIG. 5A is a plan view of a conveyance plate according to an embodiment of the present disclosure.
Figure 5B:
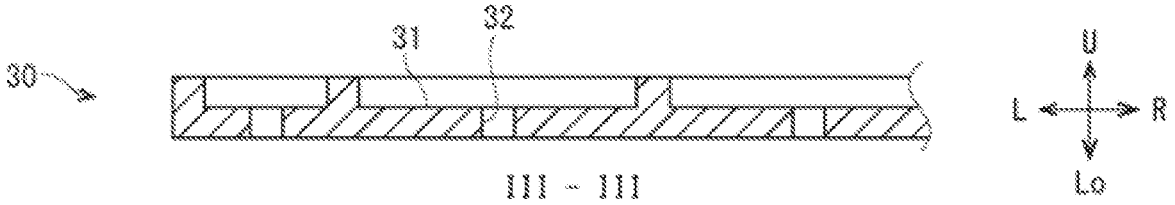
FIG. 5B is a cross-sectional view of the conveyance plate in a region other than the facing region according to an embodiment of the present disclosure.
Figure 5C:
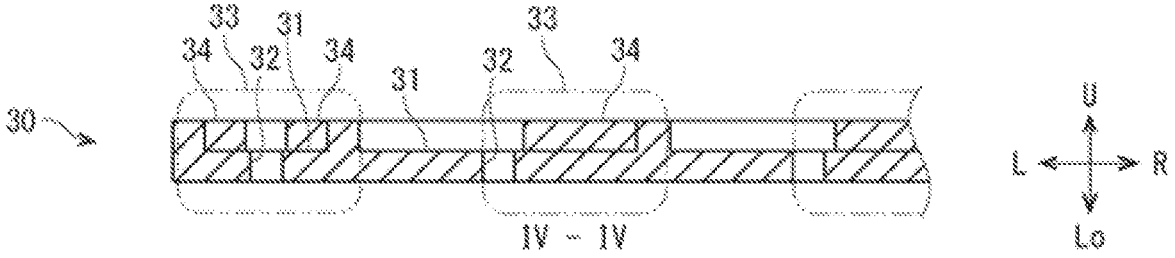
FIG. 5C is a cross-sectional view of the conveyance plate in the facing region according to an embodiment of the present disclosure.
Figure 5D:
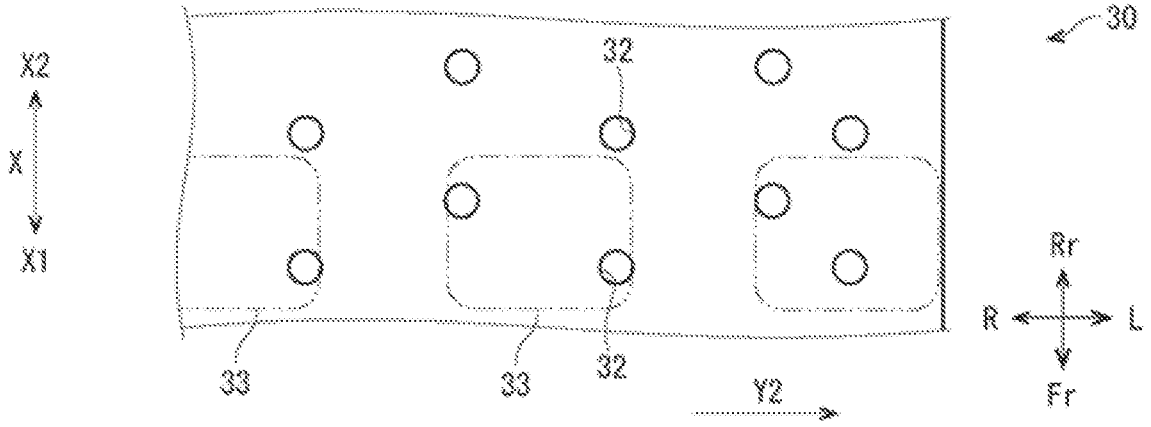
FIG. 5D is a bottom view of a carrier plate according to an embodiment of the present disclosure.
Figure 6:
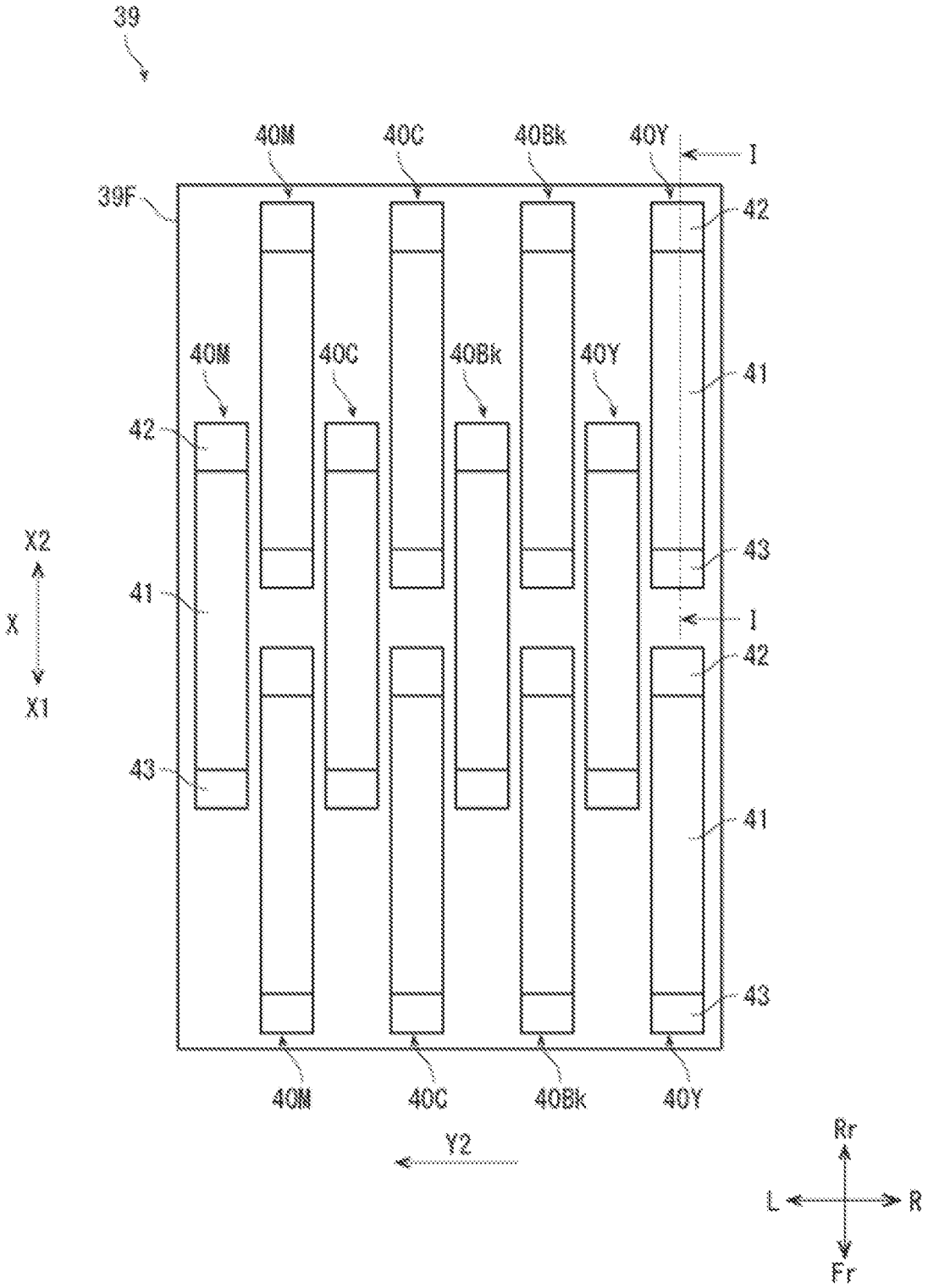
FIG. 6 is a plan view of an image forming unit according to an embodiment of the present disclosure.
Figure 7:
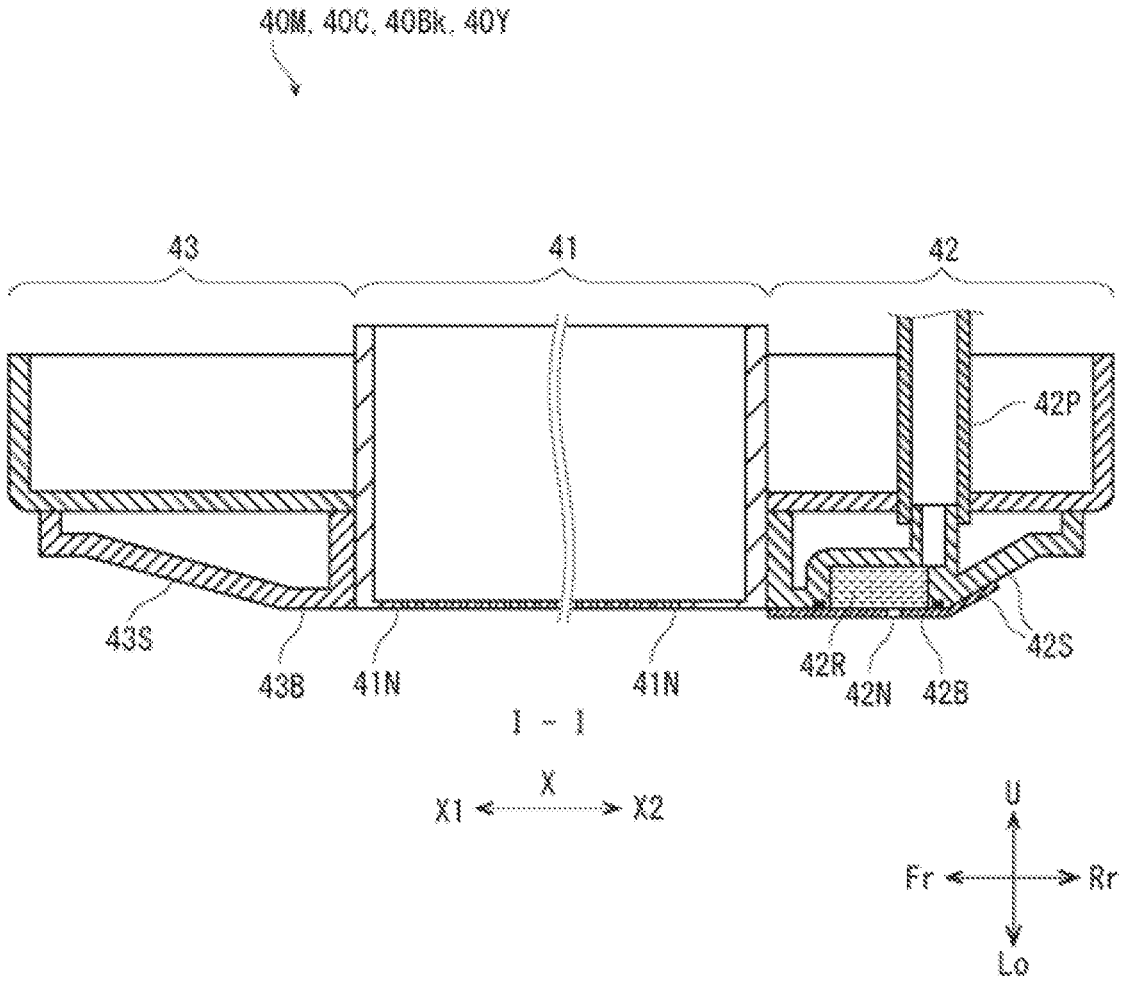
FIG. 7 is a cross-sectional view of an inkjet head according to an embodiment of the present disclosure.

Next, the configuration of each unit of the printer 1 will be described in detail with reference to FIGS. 2 to 9A. FIG. 2 is a cross-sectional view of the image forming unit 39 and the print conveyance unit 44. FIG. 3 is a plan view of the conveyance plate 30 and the conveyance belt 45. FIG. 4 is a bottom view of the conveyance plate 30 and the conveyance belt 45. FIG. 5A is a plan view of the conveyance plate 30. FIG. 5B is a cross-sectional view of the conveyance plate 30 other than the facing region 33 (cross section III-III in FIG. 5A). FIG. 5C is a cross-sectional view of the conveyance plate 30 in the facing region 33 (cross section IV-IV in 5A). FIG. 5D is a bottom view of the conveyance plate 30. FIG. 6 is a plan view of the image forming unit 39. FIG. 7 is a cross-sectional view of the inkjet heads 40Y, 40Bk, 40C, and 40M (cross section I-I in FIG. 6).

Figure 8:
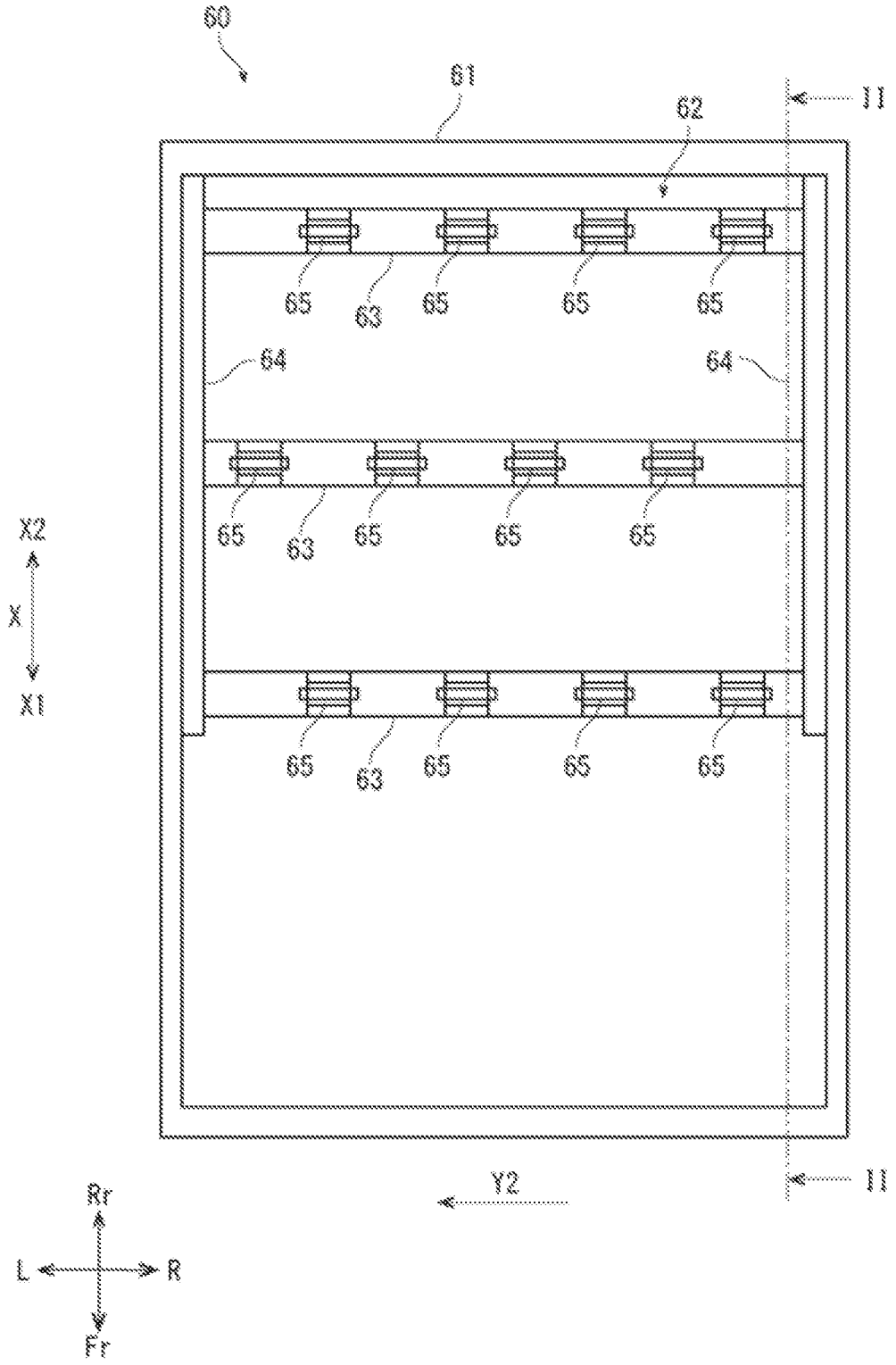
FIG. 8 is a plan view of a cleaning unit according to an embodiment of the present disclosure.
Figure 9A:
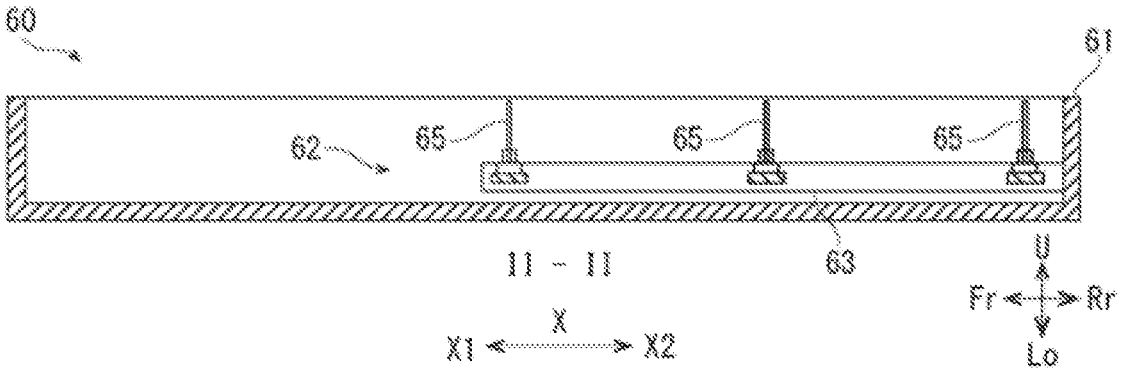
FIG. 9A is a cross-sectional view of a cleaning unit according to an embodiment of the present disclosure.

FIG. 8 is a plan view of the cleaning unit 60. FIG. 9A is a cross-sectional view of the cleaning unit 60 (cross section II-II in FIG. 6).

The printer 1 includes a conveyance belt 45, a conveyance plate 30, a suction unit 47, inkjet heads 40Y, 40Bk, 40C, and 40M, and a cleaning unit 60. The conveyance belt 45 is an endless belt having a plurality of through holes 45H and wound around a plurality of rollers. The conveyance plate 30 includes a plurality of recessed portions 31 formed in an upper surface thereof and a plurality of through holes 32 formed in bottom portions of the plurality of recessed portions 31, and the upper surface of the conveyance plate 30 contacts an inner peripheral surface of the conveyance belt 45. The suction unit 47 sucks air from the plurality of through holes 32 of the conveyance plate 30 to cause the conveyance belt 45 to suck the sheet S. Each of the inkjet heads 40Y, 40Bk, 40C, and 40M includes a head main body 41 having a lower surface formed with a plurality of nozzles 41N arranged in the width direction X of the conveyance belt 45 intersecting the conveyance direction Y2 of the conveyance belt 45, a head rear end 42 (an example of a head end) adjacent to a rear end of the head main body 41, and a head front end 43 (an example of a head end) adjacent to a front end of the head main body 41. The inkjet heads 40Y, 40Bk, 40C, and 40M face the upper surface of the conveyance plate 30 via the conveyance belt 45. The cleaning unit 60 removes the ink adhering to the lower surface of the head main body 41 by bringing a wiping blade 65 (an example of a cleaning member) into contact with the lower surface of the head main body 41 and sliding the wiping blade 65 in the width direction X. The depth of the recessed portion 31 in a facing region 33 facing the head rear end 42 and the head front end 43 of the conveying plate 30 is shallower than the depth of the recessed portion 31 in the region other than the facing region 33. A supply port 42N through which the cleaning liquid is supplied to the wiping blade 65 is provided on the lower surface of the head rear end 42. The lower surface of the head front end 43 is provided with an inclined portion 43S which is inclined so as to become higher as it goes away from the head main body 41. The conveyance belt 45, the conveyance plate 30, and the suction unit 47 are included in the print conveyance unit 44 described above.

[Conveyance Belt]

The conveyance belt 45 (see FIG. 2) is an endless belt having a width in the width direction X larger than the width of the sheet S of the maximum size, and includes a plurality of circular through holes 45H (see FIGS. 3 and 4) The plurality of through holes 45H are arranged in rows at intervals in the conveyance direction Y2, and a plurality of similar rows are arranged in a staggered manner in the width direction X.

[Conveyance Plate]

The conveyance plate 30 (see FIGS. 2 to 5D) is a plate-shaped member having a width in the width direction X larger than the width of the conveyance belt 45. The conveyance plate 30 is disposed substantially horizontally between the driving roller 46*a* and the driven roller 46*e*, and the upper surface of the conveyance plate 30 is in contact with the inner circumferential surface of the conveyance belt 45. The plurality of recessed portions 31 are formed in a groove shape whose longitudinal direction is the conveyance direction Y2. The recessed portions 31 each have a side wall portion perpendicular to the upper surface of the conveyance plate 30 and a bottom portion parallel to the upper surface of the conveyance plate 30. As viewed from above, the both end portions of the recessed portion 31 in the longitudinal direction are formed in a semicircular shape. A circular through hole 32 penetrating up to the lower surface of the conveyance plate 30 is formed in the central portion of the bottom portion of the recessed portion 31. The end portion of the through hole 32 opposite to the recessed portion 31 may be connected to the lower surface of the conveyance plate 30, not to the lower surface of the conveyance plate 30. The plurality of recessed portions 31 are arranged in rows at intervals in the conveyance direction Y2, and a plurality of similar rows are arranged in a staggered manner in the width direction X.

[Suction Unit]

A suction unit 47 is provided below the conveyance plate 30 (see FIG. 2), and includes a chamber 47C, a fan 47F, and a duct 47D. The chamber 47C is formed in a box shape with an open top, and is in contact with the lower surface of the conveyance plate 30. A suction port 47H is formed in the bottom of the chamber 47C, and a fan 47F is connected to the suction port 47H. The fan 47F sucks air from the suction port 47H to generate an air current flowing from the through hole 45H of the conveyance belt 45 to the outside of the housing 10 through the recessed portion 31 and the through hole 32 of the conveyance plate 30, the chamber 47C, the suction port 47H, and the duct 47D. That is, the suction unit 47 sucks air from the suction port 47H positioned opposite to the recessed portion 31 with respect to the through hole 32, to generate an air current. The suction roller 46*f* is provided so as to sandwich the conveyance belt 45 between the suction roller 46*f* and the end portion on the upstream side in the conveyance direction of the conveyance plate 30, and is biased downward by a spring or the like (not illustrated). By the suction roller 46*f* causing the sheet S to abut against the conveyance belt 45, suction of the sheet S to the conveyance belt 45 is promoted.

[Elevating Mechanism]

The print conveyance unit 44 is provided with an elevating mechanism (not shown), which includes a rack and pinion, for example, and elevates the print conveyance unit 44 between a print conveyance position shown in FIG. 1 and a retracted position below the print conveyance position.

[Inkjet Head]

The inkjet heads 40Y, 40Bk, 40C, and 40M (see FIG. 6) are supported by a head frame 39F fixed to the housing 10. A plurality of inkjet heads 40Y, 40Bk, 40C and 40M are arranged in a staggered manner in the width direction X for each ink color. In this example, three inkjet heads 40Y, 40Bk, 40C, and 40M are arranged for each ink color, but the number of inkjet heads 40Y, 40Bk, 40C, and 40M may be one, two, or four or more.

The inkjet heads 40Y, 40Bk, 40C, and 40M (see FIG. 7) each include a head main body 41, a head rear end 42 (an example of a head end) provided on the rear side of the head main body 41, and a head front end 43 (an example of a head end) provided on the front side of the head main body 41, and are provided such that the lower surface of the head main body 41 is substantially horizontal.

[Head Main Body]

The lower surface of the head main body 41 includes a plurality of nozzle 41N arranged in the width direction X. The head main body 41 is connected to an ink container by a pipe, and ink contained in the ink container is supplied to the head main body 41 by a pump (not shown). The nozzle 41N includes, for example, a piezoelectric element (not shown), and the piezoelectric element is deformed by application of a voltage, thereby to eject an ink.

[Head Rear End]

The head rear end 42 includes a pipe 42P whose one end is connected to a tank (not shown) that stores the cleaning liquid, a storage portion 42R connected to the other end of the pipe 42P, and a supply port 42N that supplies the cleaning liquid. The lower surface of the head rear end 42 includes a bottom portion 42B and an inclined portion 42S formed on the rear side of the bottom portion 42B and inclined such that the rear side is higher than the front side. The bottom portion 42B is formed at substantially the same height as the lower surface of the head main body 41. The cleaning liquid is, for example, a liquid obtained by removing the coloring material from the ink, and is a liquid containing water and a solvent as main components. The storage portion 42R includes a porous member that stores the cleaning liquid. The supply port 42N is formed on the bottom portion 42B and is connected to the storage portion 42R.

[Head Front End]

The lower surface of the head front end 43 includes a bottom portion 43B and an inclined portion 43S formed on the front side of the bottom portion 43B and inclined such that the front side is higher than the rear side. The bottom portion 43B is formed at substantially the same height as the lower surface of the head main body 41.

[Cleaning Unit]

The cleaning unit 60 (see FIGS. 8 and 9A) includes an ink receiving unit 61 and a wiping unit 62. The ink receiving unit 61 is formed in a box shape with an open upper portion, and is formed in a rectangular shape including all of the inkjet heads 40Y, 40Bk, 40C, and 40M of the image forming unit 39 when viewed from above. The wiping unit 62 includes a first support member 63, a second support member 64, and a wiping blade 65, and is accommodated in the ink receiving unit 61.

The first support member 63 is a rod-shaped member whose longitudinal direction is the conveyance direction Y2, and the second support member 64 is a rod-shaped member whose longitudinal direction is the width direction X. The three first support members 63 are disposed at the same interval as the interval of the head rear end 42 in the width direction X. Both end portions of the three first support members 63 are fixed to the two second support members 64. The wiping blades 65 are formed in four portions corresponding to the head rear ends 42 of the first support member 63. The wiping blade 65 is formed of urethane rubber, silicone rubber, or the like, has flexibility, and is provided so as to protrude upward from the upper surface of the first support member 63. The second support member 64 is connected to a drive mechanism (not illustrated) such as a rack and pinion, and the wiping unit 62 is driven in the width direction X by the drive mechanism.

[Moving Mechanism]

The cleaning unit 60 includes a moving mechanism (not illustrated). The moving mechanism includes, for example, a frame that supports the ink receiving unit 61 and a rack and pinion that moves the frame in the horizontal direction. The frame supports the ink receiving unit 61 by a structure in which the ink receiving unit 61 can move up and down. The moving mechanism moves the cleaning unit 60 between a storage position illustrated in FIG. 1 and a facing position where the print conveyance unit 44 faces the lower surface of the image forming unit 39 in a space formed by the lowering of the print conveyance unit 44 by the elevating mechanism. By raising the print conveyance unit 44 when the cleaning unit 60 is positioned in the facing position, the print conveyance unit 44 pushes up the cleaning unit 60. The elevating mechanism raises and lowers the cleaning unit 60 between the facing position and a cleaning position above the facing position.

Figure 9B:
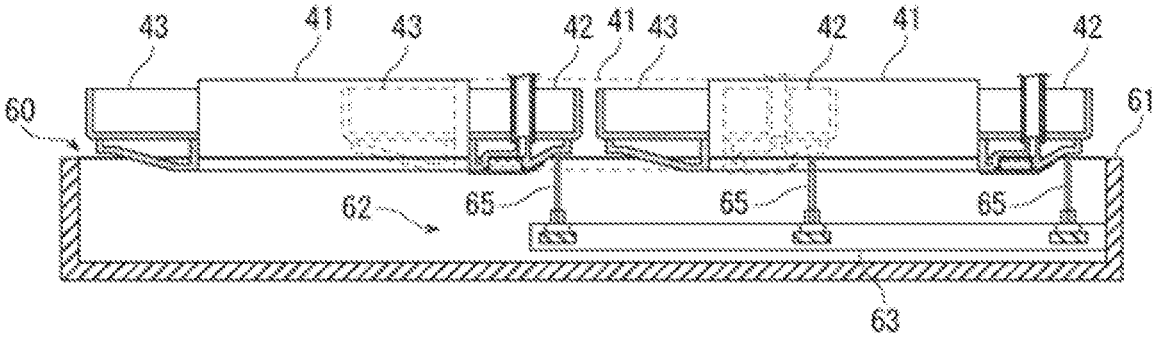
FIG. 9B is a cross-sectional view illustrating an operation of the cleaning unit according to an embodiment of the present disclosure.
Figure 9C:
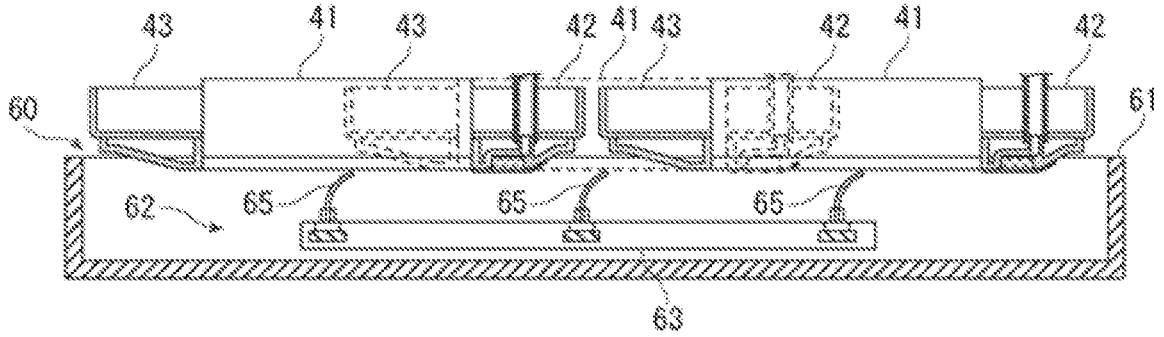
FIG. 9C is a cross-sectional view illustrating an operation of the cleaning unit according to an embodiment of the present disclosure.
Figure 9D:
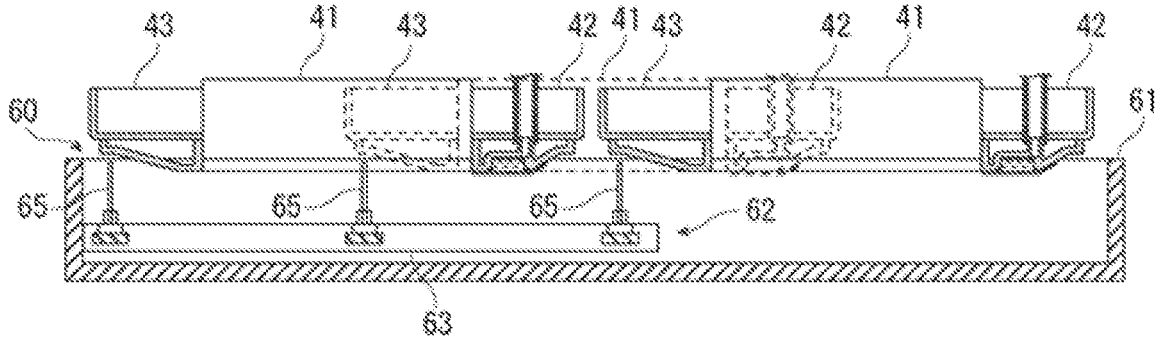
FIG. 9D is a cross-sectional view illustrating an operation of the cleaning unit according to an embodiment of the present disclosure.

Here, the operation of the cleaning unit 60 will be described with reference to FIGS. 7 to 9D. FIGS. 9B to 9D are cross-sectional views showing the operation of the cleaning unit 60. The control unit 2 executes the following processing when a condition for executing cleaning is satisfied or when an instruction for executing cleaning is input. First, the control unit 2 causes the elevating mechanism to lower the print conveyance unit 44 located at the print conveyance position to the retreat position. Next, the control unit 2 causes the moving mechanism to move the cleaning unit 60 located at the storage position to the facing position, and causes the elevating mechanism to raise the print conveyance unit 44, thereby raising the cleaning unit 60 to the cleaning position. FIG. 9B shows a state where the cleaning unit 60 is located at the cleaning position. The wiping unit 62 is located at the initial position, and the upper end portion of the wiping blade 65 faces the rear end portion of the inclined portion 42S of the head rear end 42.

Next, the control unit 2 causes the drive mechanism to move the wiping unit 62 forward (in the X1 direction), whereupon the upper end portion of the wiping blade 65 comes into contact with the 42S of the inclined portion of the head rear end 42, and the wiping blade 65 slides forward while gradually flexing rearward Subsequently, the wiping blade 65 scrapes off the cleaning liquid hanging down in a dome shape from the supply port 42N at the bottom portion 42B of the head rear end 42 and slides forward.

Droplets of ink ejected from the nozzle 41N adhere to the lower surface of the head main body 41. The adhering ink is diluted by the cleaning liquid adhering to the wiping blade 65, and the wiping blade 65 slides forward while scraping off the diluted ink (see FIG. 9C). Most of the ink scraped off by the wiping blade 65 falls down in the ink receiving unit 61. Subsequently, the wiping blade 65 passes through the bottom portion 43B of the head front end 43 and slides on the inclined portion 43S while gradually recovering the deflection, and the upper end portion of the wiping blade 65 is separated from the inclined portion 43S at the front end portion of the inclined portion 43S (see FIG. 9D).

Subsequently, the control unit 2 lowers the cleaning unit 60 to the facing position by lowering the print conveyance unit 44 by the elevating mechanism, returns the wiping unit 62 to the initial position by moving the wiping unit 62 rearward (in the X2 direction) by the driving mechanism, and moves the cleaning unit 60 to the storage position by the moving mechanism. Finally, the control unit 2 raises the print conveyance unit 44 to the print conveyance position by the elevating mechanism.

In the printer 1, in order to eliminate the clogging of the nozzle 41N which is clogged with the fixed ink or foreign matter, the ink may be pressurized by a pump or the like from the outside of the inkjet head 40Y, 40Bk, 40C, or 40M. In such a case, the pressurized ink is pushed out from the nozzle 41N and is accumulated on the lower surface of the head main body 41. The cleaning unit 60 not only scrapes off the droplets of the adhered ink but also scrapes off the ink thus accumulated.

Figure 10A:
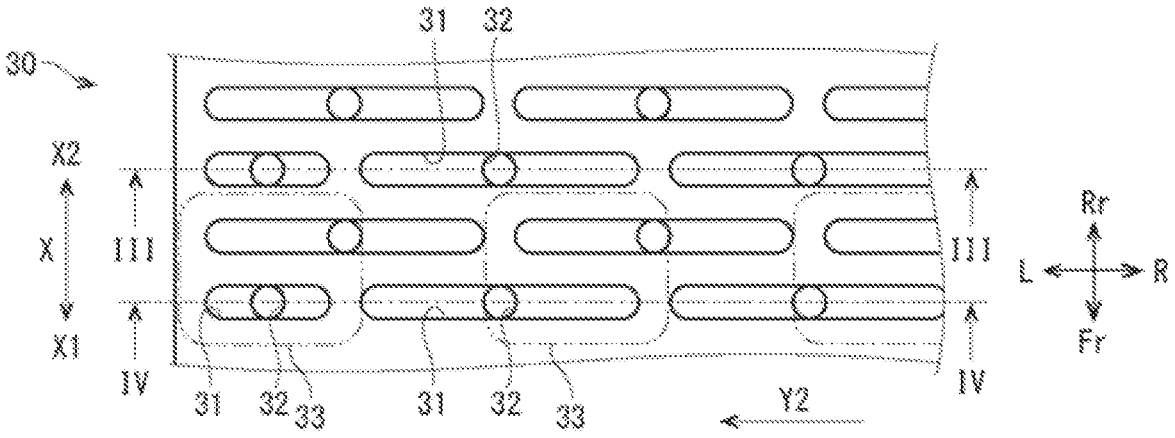
FIG. 10A is a plan view of a conventional conveyance plate.
Figure 10B:
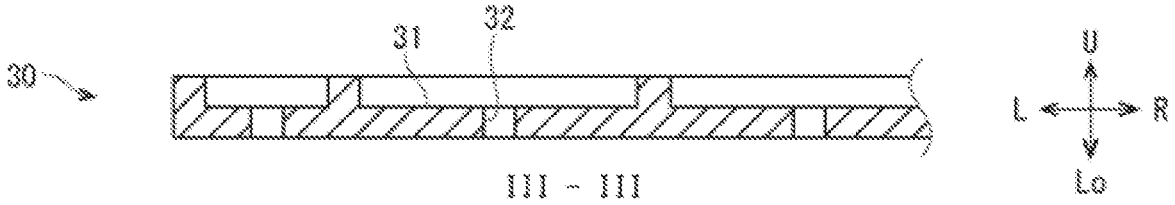
FIG. 10B is a cross-sectional view of the conveyance plate 130 in a region other than the conventional facing region.
Figure 10C:
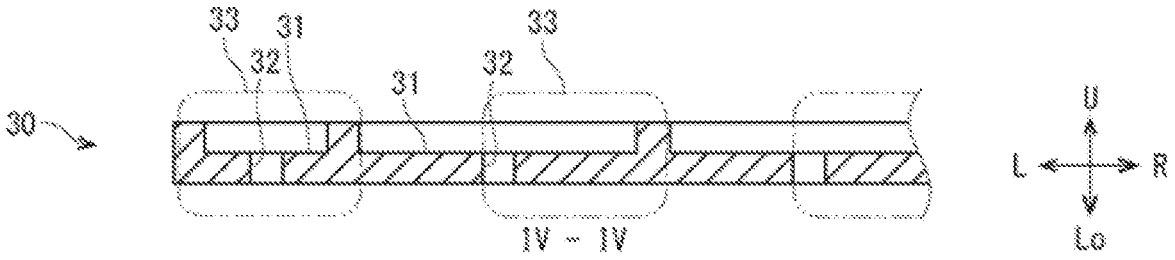
FIG. 10C is a cross-sectional view of the conveyance plate 130 in the conventional facing region.
Figure 10D:
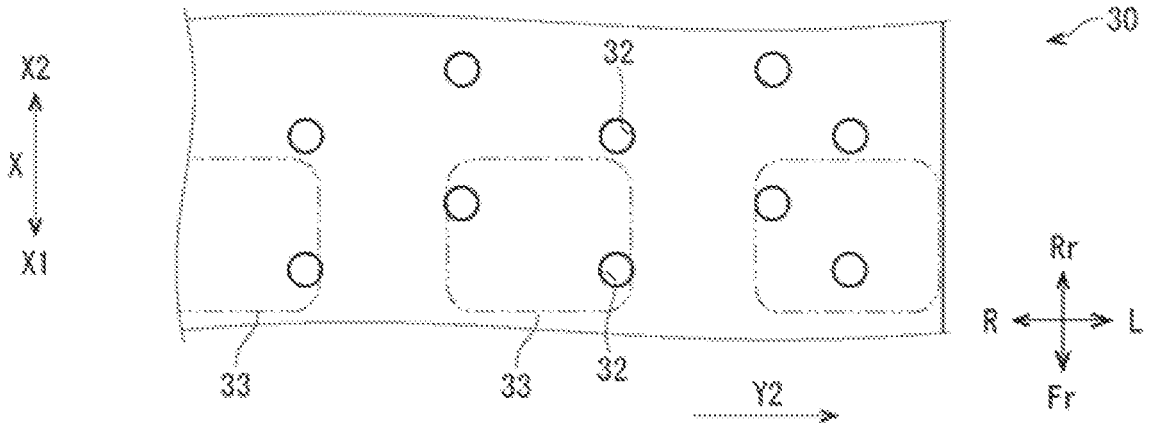
FIG. 10D is a bottom view of a conventional conveyance plate.

Here, referring to FIGS. 10A to 10D, a configuration of a conventional conveyance plate 130 will be described. FIG. 10A is a plan view of the conveyance plate 130. FIG. 10B is a cross-sectional view of the conveyance plate 130 other than the facing region 133. FIG. 10C is a cross-sectional view of the conveyance plate 130 in the facing region 133. FIG. 10D is a bottom view of the conveyance plate 130.

Hereinafter, the facing region 133 means a region facing the head rear end 42 and the head front end 43 on the upper surface of the conveyance plate 130. The upper surface of the conveyance plate 130 does not face the head rear end 42 and the head front end 43 except in the facing region 133. In the conventional conveyance plate 130, the ratio of the recessed portions 131 per unit area in the facing region 133 is equal to the ratio of the recessed portions 131 per unit area in the region other than the facing region 133.

Since the sheet S is conveyed to the conveyance belt 45 after its posture and timing are adjusted by the registration roller pair 25, the sheets S are conveyed with a gap between the sheets S. In a region on the conveyance belt 45 where the sheet S is placed, the sheet S is attracted to the conveyance belt 45 to close the through hole 45H. However, in the gap between the sheets S, an air flow passes through the through hole 45H downward, and thus the speed and direction of the air flow periodically change in a space between the inkjet heads 40Y, 40Bk, 40C, and 40M and the conveyance belt 45.

However, in the inkjet heads 40Y, 40Bk, 40C, and 40M, some of the cleaning liquid scraped off from the supply port 42N by the wiping blade 65 may adhere to the bottom portion 42B, and some of the ink scraped off from the lower surface of the head main body 41 by the wiping blade 65 or the mixture of the ink and the cleaning liquid that does not fall onto the ink receiving unit 61 but remains on the wiping blade 65 may adhere to the bottom portion 43B or the inclined portion 43S of the head front end 43. As the cleaning is repeated, the cleaning liquid, the ink, and the mixture thereof are gradually accumulated in the head rear end 42 and the head front end 43. Then, when the gap between the sheets S passes below the head rear end 42 and the head front end 43, the accumulated cleaning liquid, the ink, and the mixture thereof may fall onto the conveyance belt 45 due to the influence of the change in the airflow.

Therefore, in the conveyance plate 30 according to the present embodiment, the depth of the recessed portion 31 in a facing region 33 facing the head rear end 42 and the head front end 43 of the conveying plate 30 is shallower than the depth of the recessed portion 31 in the region other than the facing region 33.

To be more specific, as shown in FIGS. 5A and 5C, the raised bottom portion 34 is provided substantially the entire region of the recessed portion 31 which is entirely included in the facing region 33. In the recessed portion 31 partially included in the facing region 33, the raised bottom portion 34 is provided only in the portion included in the facing region 33. However, in any case, the raised bottom portion 34 is provided in a range excluding the through hole 32. On the other hand, as illustrated in FIGS. 5A and 5B, the raised bottom portion 34 is not provided in the recessed portion 31 whose entirety is not included in the facing region 33. The vertical thickness of the raised bottom portion 34 is thinner than the depth of the recessed portion 31, and is about a half of the depth of the recessed portion 31, for example. The raised bottom portion 34 may be formed integrally with the conveyance plate 30, or may be formed by fitting a member formed separately from the conveyance plate 30 into the recessed portion 31.

According to this configuration, in the facing region 33, they air flow flowing into the through hole 32 is smaller than that in the region other than the facing region 33, and thus a change in the air flow when the gap between the sheets S passes below the head rear end 42 and the head front end 43 is suppressed. As a result, the cleaning liquid is suppressed from falling off from the head rear end 42 in the gap between the conveyed sheets S to the conveyance belt 45. In addition, ink is suppressed from falling off from the head front end 43 in the gap between the conveyed sheets S to the conveyance belt 45.

According to the printer 1 according to the embodiment described above, the liquid is suppressed from falling from the head end portions (the head rear end 42 and the head front end 43) to the conveyance belt 45 in the gap between the conveyed sheets S. According to the printer 1 according to the embodiment, since the inclined portion 41S which is inclined so as to become higher as it goes away from the head main body 41 is provided on the lower surface of the head front end 43, scattering of the ink from the wiping blade 65 is suppressed. According to the printer 1 according to the present embodiment, since the supply port 42N which supplies the cleaning liquid to the wiping blade 65 is provided on the lower surface of the head rear end 42, removal of the ink adhered to the lower surface of the head main body 41 is promoted.

The above-described embodiment may be modified as follows.

Figure 11A:
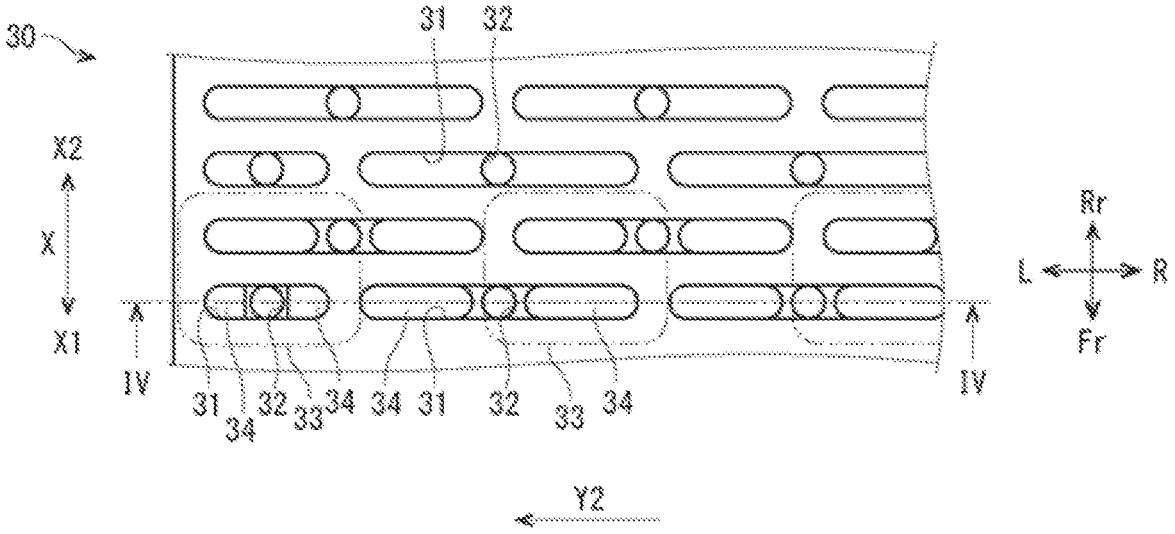
FIG. 11A is a plan view of a conveyance plate according to a modification of an embodiment of the present disclosure.
Figure 11B:
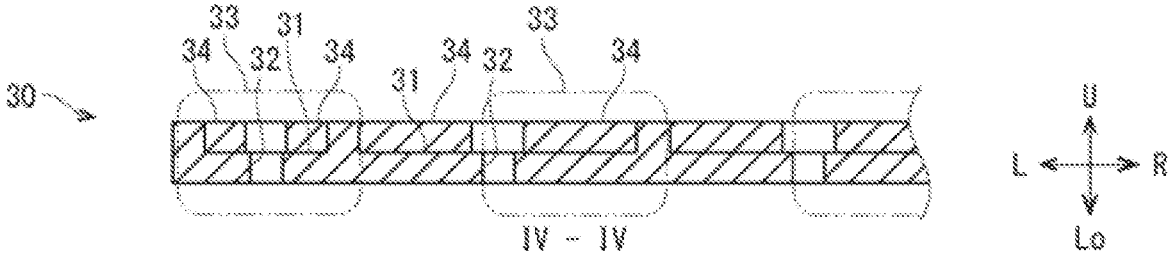
FIG. 11B is a cross-sectional view of a conveyance plate according to a modification of an embodiment of the present disclosure.

In the example illustrated in FIGS. 11A and 11B, in the recessed portion 31 partially included in the facing region 33, the raised bottom portion 34 is provided not only in the portion included in the facing region 33 but also in the portion not included in the facing region 33. According to this configuration, compared to the above-described embodiment, in the recessed portion 31 partially included in the facing region 33, the airflow flowing into the through hole 32 is reduced, and thus the liquid is suppressed from falling from the head end portion.

Figure 12A:
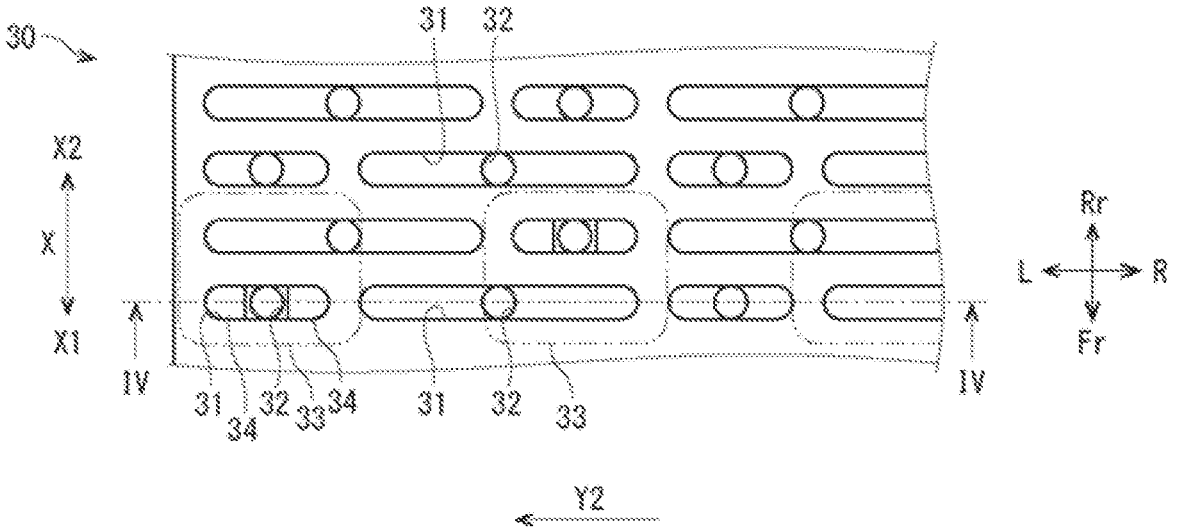
FIG. 12A is a plan view of a conveyance plate according to a modification of an embodiment of the present disclosure.
Figure 12B:
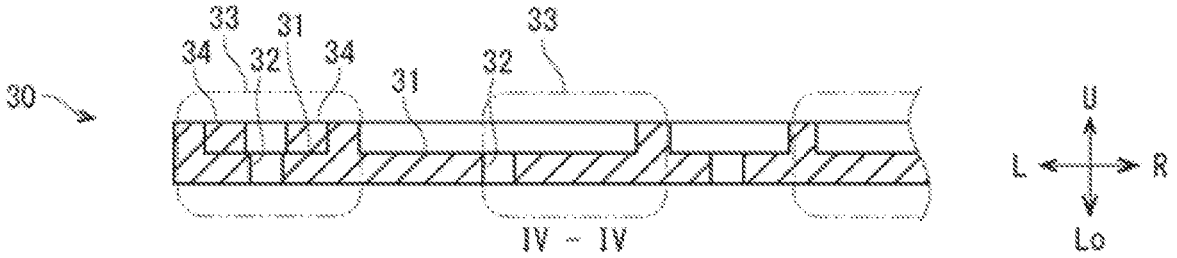
FIG. 12B is a cross-sectional view of a conveyance plate according to a modification of an embodiment of the present disclosure.

FIGS. 12A and 12B illustrate an example in which the number of recessed portion 31 entirely included in the facing region 33 is larger than that in the above-described embodiment for the sake of convenience of description. In this example, the raised bottom portion 34 is provided in substantially the entire region of the recessed portion 31 entirely included in the facing region 33. On the other hand, the raised bottom portion 34 is not provided in the recessed portion 31 partially included in the facing region 33. Also with this configuration, in the facing region 33, the airflow flowing into the through hole 32 becomes smaller than that in the region other than the facing region 33, and therefore, the falling of the liquid from the head end portion is suppressed.

Figure 13A:
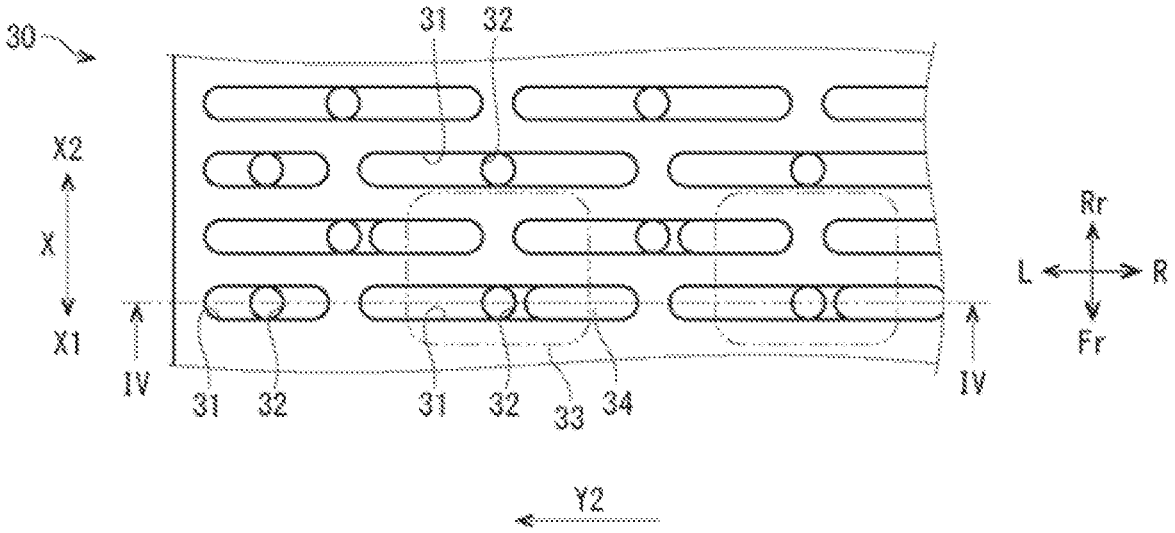
FIG. 13A is a plan view of a conveyance plate according to a modification of an embodiment of the present disclosure.
Figure 13B:
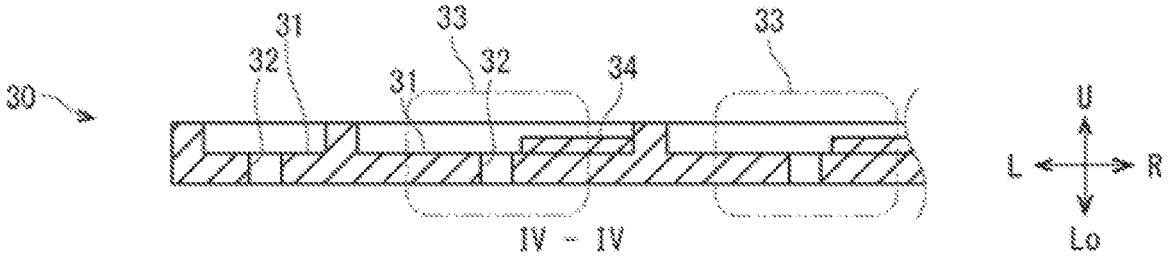
FIG. 13B is a cross-sectional view of a conveyance plate according to a modification of an embodiment of the present disclosure.

For convenience of description, FIGS. 13A and 13B illustrate an example of the recessed portion 31 partially included in the facing region 33 and for which the facing region 33 is present on both left and right sides of the through hole 32. In the recessed portion 31 of this embodiment, the raised bottom portion 34 is provided only in a portion on the right side of the through hole 32. Note that the raised bottom portion 34 may be provided only in the left side of the through hole 32. Also with this configuration, in the facing region 33, the amount of airflow flowing into the through hole 32 is smaller than that in the region other than the facing region 33, and thus the liquid is prevented from falling from the head end portion.

Figure 14A:
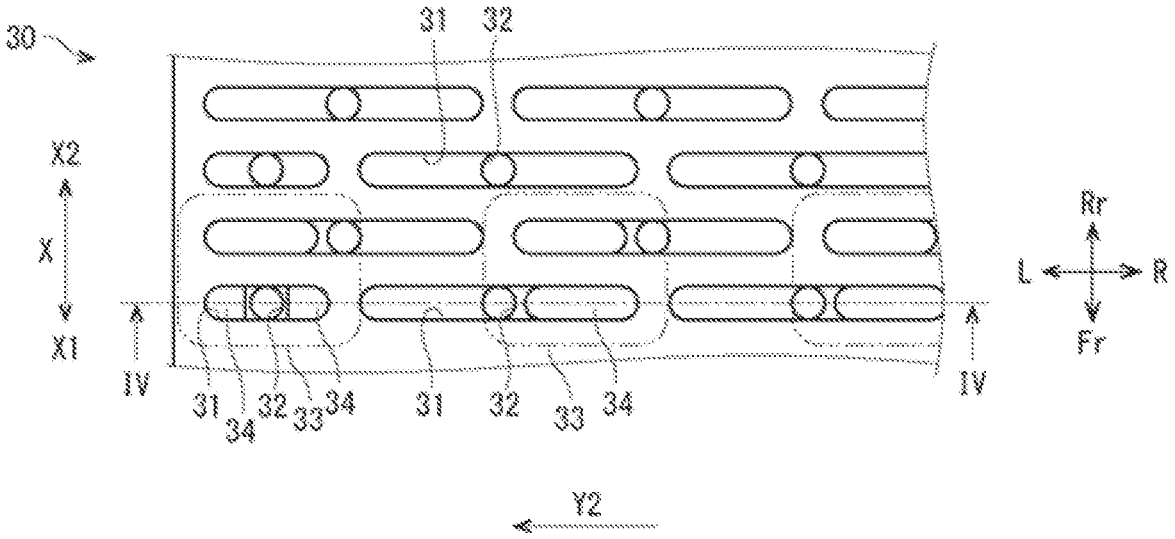
FIG. 14A is a plan view of a conveyance plate according to a modification of an embodiment of the present disclosure.
Figure 14B:
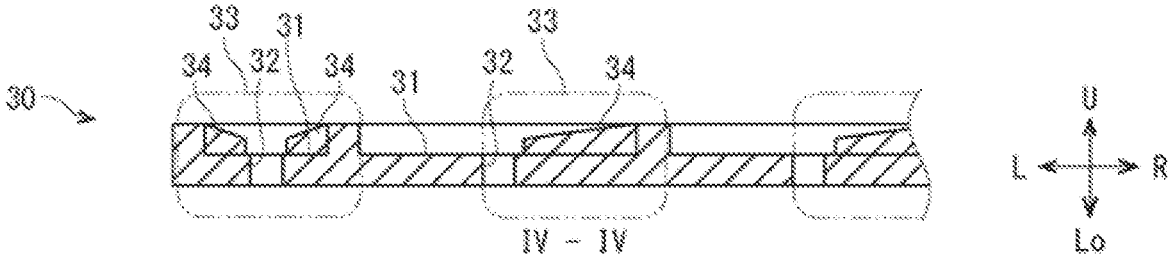
FIG. 14B is a cross-sectional view of a conveyance plate according to a modification of an embodiment of the present disclosure.

In the example shown in FIGS. 14A and 14B, the height of the upper surface of the raised bottom portion 34 decreases toward the through hole 32. In other words, the depth of the recessed portion 31 in the facing region 33 increases toward the through hole 32. According to this configuration as well, in the facing region 33, the amount of airflow flowing into the through hole 32 is smaller than in the region other than the facing region 33, and the liquid is suppressed from falling from the head end portion.

Figure 15A:
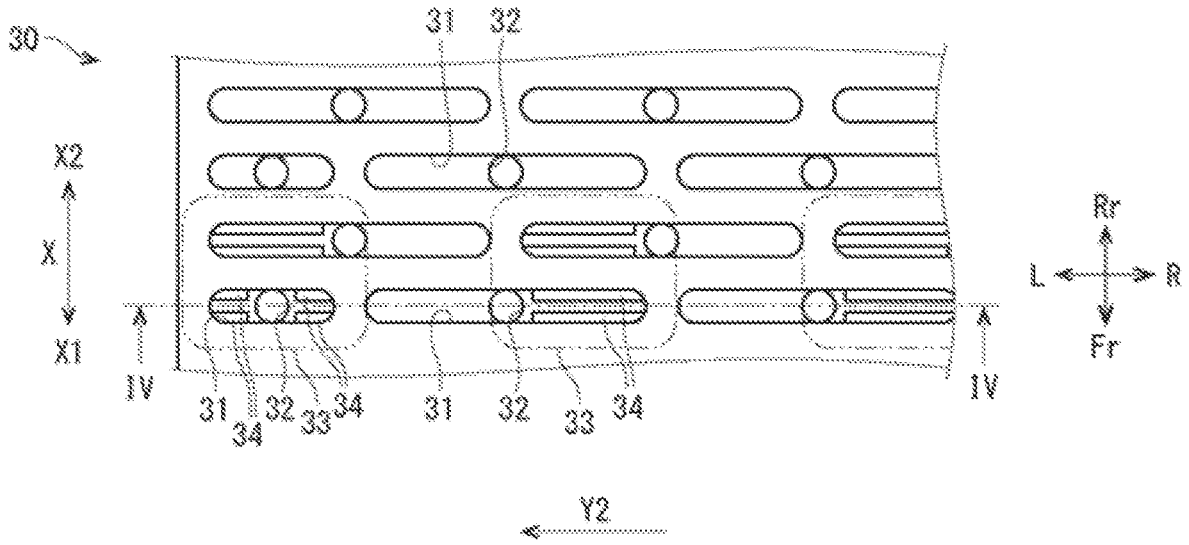
FIG. 15A is a plan view of a conveyance plate according to a modification of an embodiment of the present disclosure.
Figure 15B:
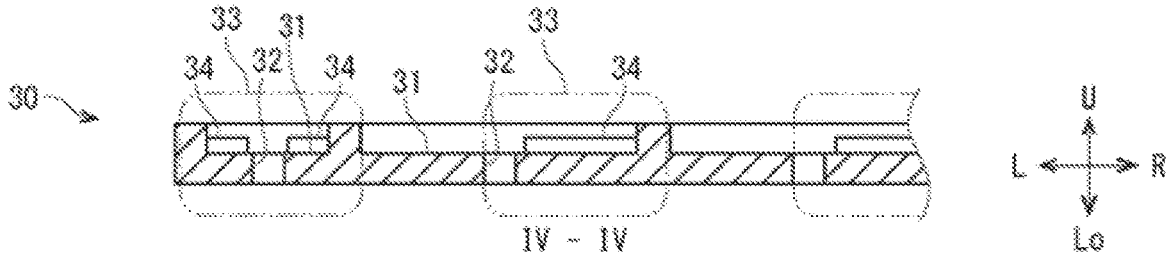
FIG. 15B is a cross-sectional view of a conveyance plate according to a modification of an embodiment of the present disclosure.

In the example shown in FIGS. 15A and 15B, pairs of raised bottom portions 34 are provided at intervals in the front-rear direction instead of the raised bottom portions 34 of the above-described embodiment. In other words, the width of the recessed portion 31 in the width direction X in the facing region 33 is narrower than the width of the recessed portion 31 in the width direction X in the region other than the facing region 33. With this configuration as well, in the facing region 33, compared to the region other than the facing region 33, the airflow flowing into the through hole 32 is reduced, and thus the liquid is suppressed from falling from the head end portion.

For convenience of explanation, FIGS. 16A to 18B show an example in which the facing region 33 is positioned closer to the right than the above embodiment by the radius of the through hole 32. Here, the radius of the through hole 32 of the recessed portion 31 that is not entirely included in the facing region 33 is referred to as a normal radius. FIGS. 16A to 18B show an example in which a flow path resistance of the through hole 32 formed through the recessed portion 31 included in the facing region 33 is larger than a flow path resistance of the through hole 32 formed through the recessed portion 31 not included in the facing region 33, in the above-described embodiment.

Figure 16A:
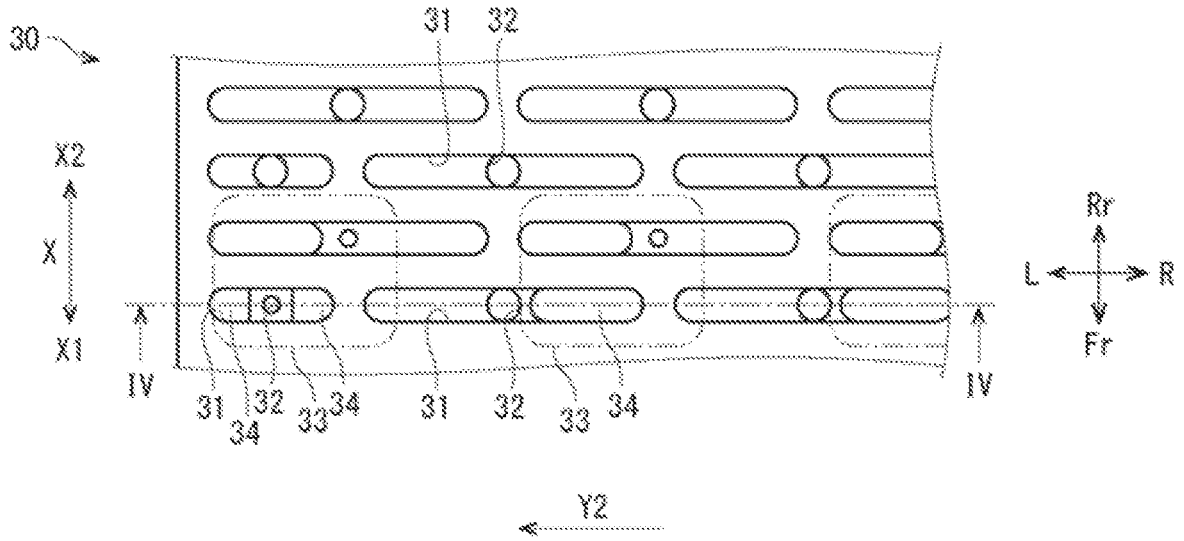
FIG. 16A is a plan view of a conveyance plate according to a modification of an embodiment of the present disclosure.
Figure 16B:
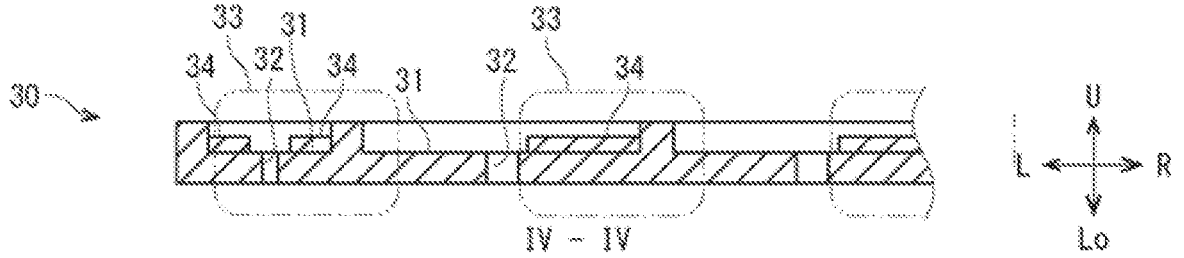
FIG. 16B is a cross-sectional view of a conveyance plate according to a modification of an embodiment of the present disclosure.

In the example illustrated in FIGS. 16A and 16B, through holes 32 having a radius smaller than a normal radius are formed in the recessed portions 31 entirely included in the facing region 33. On the other hand, in the recessed portions 31 partially included in the facing region 33, through holes 32 having a radius smaller than a normal radius are formed when the through holes 32 are located inside the facing region 33, and through holes 32 having a normal radius are formed when the through holes 32 are located outside the facing region 33. According to this configuration, compared to the above-described embodiment, since the airflow flowing into the through holes 32 included in the facing region 33 is reduced, and therefore the effect of suppressing the liquid from falling from the head end portion is increased.

Figure 17A:
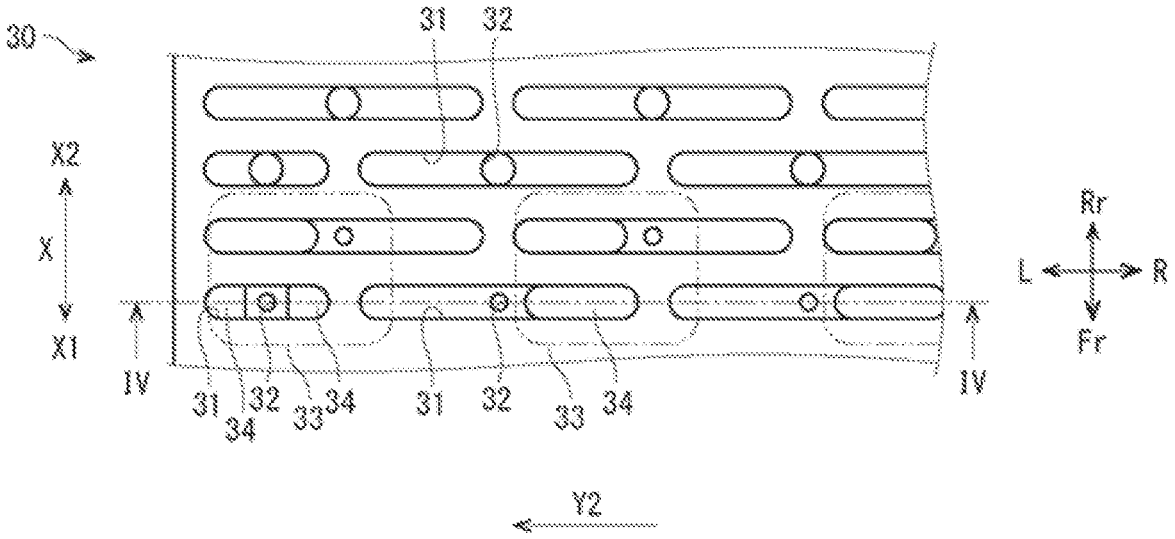
FIG. 17A is a plan view of a conveyance plate according to a modification of an embodiment of the present disclosure.
Figure 17B:
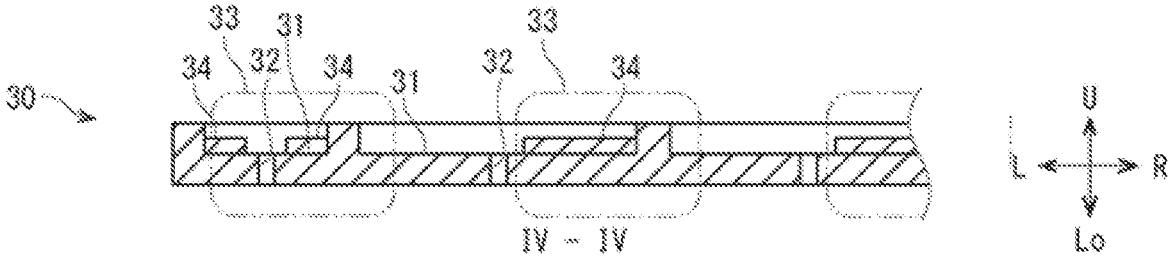
FIG. 17B is a cross-sectional view of a conveyance plate according to a modification of an embodiment of the present disclosure.

In the example shown in FIGS. 17A and 17B, through holes 32 having a radius smaller than a normal radius are formed in all of the recessed portions 31 partially or entirely included in the facing region 33. According to this configuration, compared to the above-described embodiment, the airflow flowing into the through holes 32 of the recessed portions 31 included in the facing region 33 is reduced, and thus the effect of suppressing the liquid from falling from the head end portion is increased.

Figure 18A:
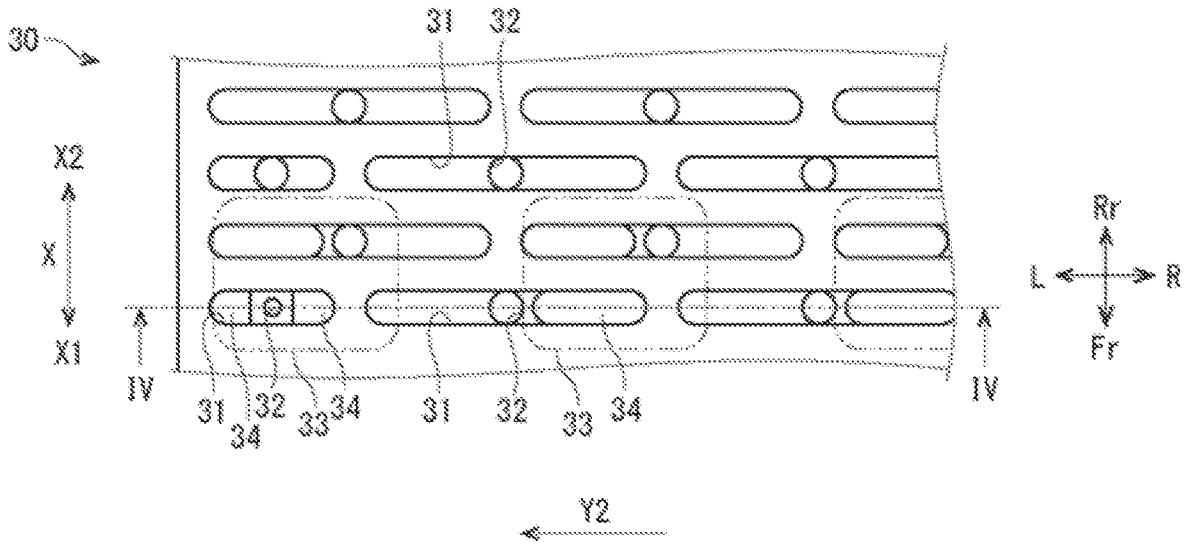
FIG. 18A is a plan view of a conveyance plate according to a modification of an embodiment of the present disclosure.
Figure 18B:
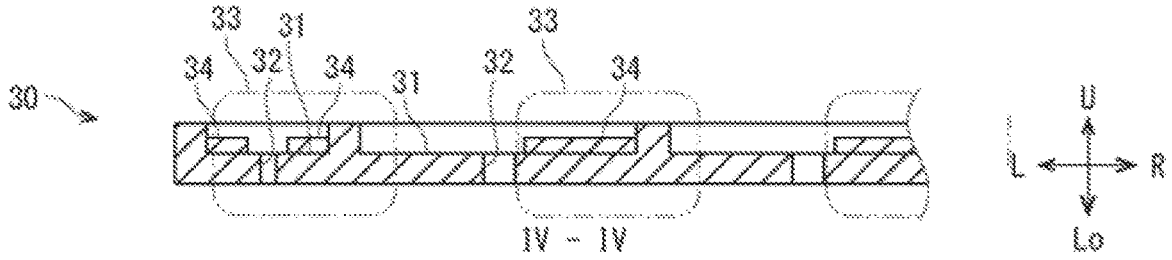
FIG. 18B is a cross-sectional view of a conveyance plate according to a modification of an embodiment of the present disclosure.

In the example shown in FIGS. 18A and 18B, the through hole 32 having a smaller radius than the normal radius is formed in the recessed portion 31 entirely included in the facing region 33. On the other hand, the through hole 32 having a normal radius is formed in the recessed portion 31 partially included in the facing region 33 regardless of whether the position of the through hole 32 is inside or outside the facing region 33. According to this configuration, compared to the above-described embodiment, since the airflow flowing into the through hole 32 of the recessed portion 31 entirely included in the facing region 33 is reduced, the effect of suppressing the liquid from falling from the head end portion is increased.

Figure 19A:
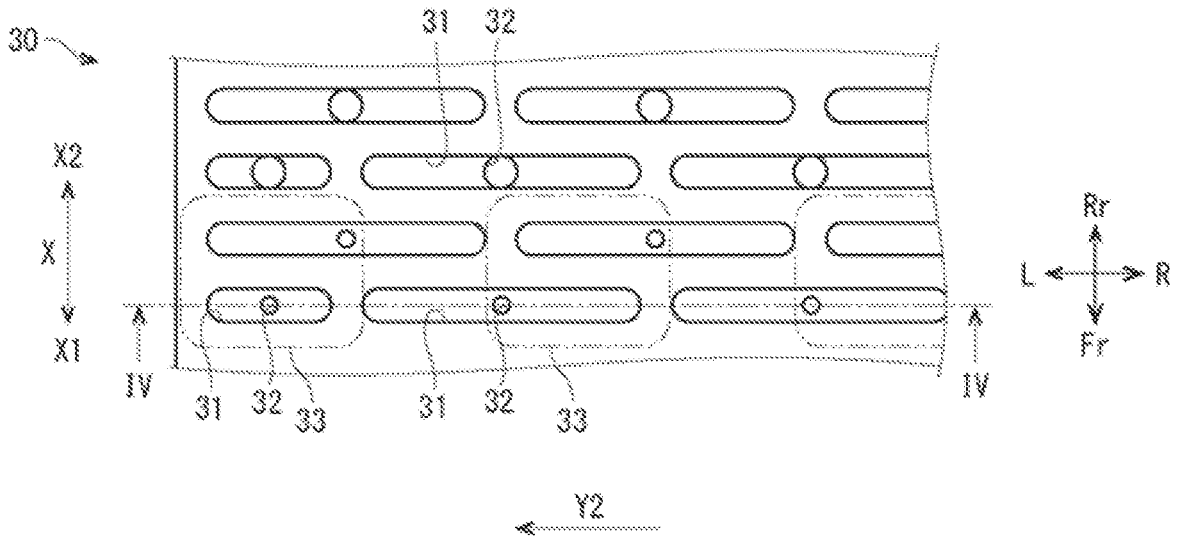
FIG. 19A is a plan view of a conveyance plate according to a modification of an embodiment of the present disclosure.
Figure 19B:
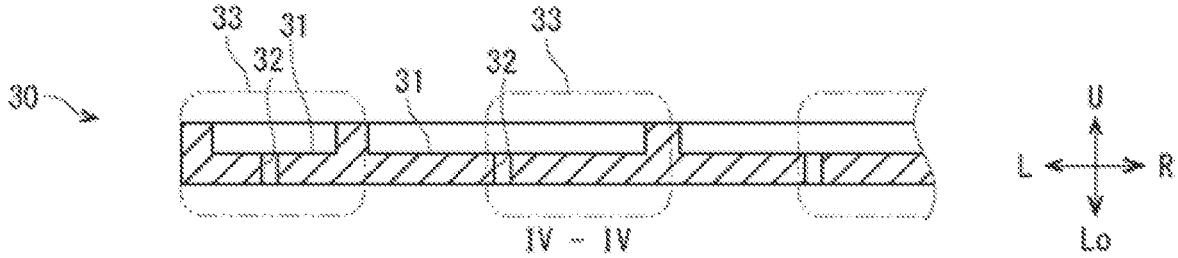
FIG. 19B is a cross-sectional view of a conveyance plate according to a modification of an embodiment of the present disclosure.

In the example shown in FIGS. 19A and 19B, the raised bottom portion 34 is not provided in the recessed portion 31 included in the facing region 33, and the through hole 32 having a smaller radius than the normal radius is formed in the recessed portion 31 included in the facing region 33. In other words, this modification includes the endless conveyance belt 45 provided with a plurality of through holes 45H and wound around a plurality of rollers; the conveyance plate 30 including a plurality of recessed portions 31 formed in an upper surface thereof and a plurality of through holes 32 formed in bottom portions of the plurality of recessed portions 31, the upper surface of the conveyance plate 30 being in contact with an inner peripheral surface of the conveyance belt 45; the suction unit 47 that sucks air from the plurality of through holes 32 of the conveyance plate 30 to cause the conveyance belt 45 to suck the sheet S; the head main body 41 in which a plurality of nozzle 41N arranged in a width direction X of the conveyance belt 45 intersecting with a conveyance direction Y2 of the conveyance belt 45 are formed on a lower surface; the head rear end 42 (an example of a head end portion) adjacent to a rear end of the head main body 41; the head front end 43 (an example of a head end portion) adjacent to a front end of the head main body 41; inkjet heads 40Y, 40Bk, 40C, 40M facing the upper surface of the conveyance plate 30 via the conveyance belt 45; and the cleaning unit 60 that removes ink adhering to the lower surface of the head main body 41 by bringing the wiping blade 65 (an example of a cleaning member) into contact with the lower surface of the head main body 41 and sliding the wiping blade 65 in the width direction X, where the inkjet recording apparatus is characterized in that the flow path resistance of a through hole 32 formed in the recessed portion 31 included in the facing region 33 of the conveyance plate 30 facing a head rear end 42 and a head front end 43 is larger than the flow path resistance of a through hole 32 formed in a recessed portion 31 not included in the facing region 33.

According to this configuration, in the facing region 33, the air flow flowing into the through hole 32 is smaller than that in the region other than the facing region 33, and thus a change in the air flow when the gap between the sheets S passes below the head rear end 42 and the head front end 43 is suppressed. As a result, the cleaning liquid is suppressed from falling off from the head rear end 42 in the gap between the conveyed sheets S to the conveyance belt 45. In addition, ink is suppressed from falling off front the head front end 43 in the gap between the conveyed sheets S to the conveyance belt 45.

In the examples shown in FIGS. 16A to 19B, the radius of the through holes 32 is made smaller than a normal radius to increase the flow path resistance of the through holes 32, but the flow path resistance may be increased by tapering the through holes 32. Alternatively, the flow path resistance may be increased by providing a cloth or the like, having an aeration property, on the lower surface of the conveyance plate 30.

In the embodiment described above, an example in which the pipe 42P, the storage portion 42R, and the supply port 42N are provided in the head rear end 42 is shown, but similar configurations may be provided in the head front end 43. In addition, similar configurations may be provided in both the head rear end 42 and the head front end 43. According to this configuration, since the cleaning liquid can be supplied from both the head rear end 42 and the head front end 43, it is possible to remove the ink in both back and forth processes in the reciprocating strokes of the wiping blade 65.

In addition, in the above-described embodiment, since the mixture of the ink and the cleaning liquid adheres to the wiping blade 65 slid from the head rear end 42 to the head front end 43, the cleaning liquid may be supplied from the head front end 43 to remove the mixture. In any case, supplying the cleaning liquid from both the head rear end 42 and the head front end 43 increases the possibility that the ink, the cleaning liquid, or the mixture thereof drops from both the head rear end 42 and the head front end 43. Therefore, it is more necessary to make the ratio of the recessed portion 31 per unit area in the facing region 33 smaller than the ratio of the recessed portion 31 per unit area in the region other that the facing region 33.

In the embodiment described above, an example is shown in which the bottom portion 42B and the inclined portion 42S are provided on the lower surface of the head rear end 42, but the inclined portion 42S may not be provided on the lower surface of the head front end 43. In the embodiment described above, an example is shown in which the bottom portion 43B and the inclined portion 43S are provided on the lower surface of the head rear end 42, but the inclined portion 43S may not be provided on the lower surface of the head front end 43.

In the above-described embodiment, are example in which the recessed portion 31 has a groove shape whose longitudinal direction is the conveyance direction Y2 has been described. However, the shape of the recessed portion 31 may be any shape such as a rectangle or an ellipse when viewed from above.

What is claimed is:

1. An inkjet recording apparatus comprising:

an endless conveyance belt having a plurality of through holes and wound around a plurality of rollers;

a conveyance plate including a plurality of recessed portions formed in an upper surface thereof and a plurality of through holes formed in bottom portions of the plurality of recessed portions, the upper surface of the conveyance plate being in contact with an inner peripheral surface of the conveyance belt;

a suction unit that sucks air from the plurality of through holes of the conveyance plate to cause the conveyance belt to suck the sheet;

an inkjet head including a head main body having a lower surface on which a plurality of nozzles to eject an ink, arranged in a width direction of the conveyance belt intersecting the conveyance direction of the conveyance belt are formed, and a head end portion on which a nozzle to eject the ink is not formed, provided adjacently to one end or both ends of the head main body in the width direction, the inkjet head facing an upper surface of the conveyance plate via the conveyance belt; and a cleaning unit that removes ink attached to a lower surface of the head main body by bringing a cleaning member into contact with the lower surface of the head main body and sliding the cleaning member in the width direction, wherein a depth of the recessed portion in a first facing region is shallower than a depth of the recessed portion in a second facing region, the first facing region being a region in the upper surface, which faces the head end portion via the conveyance belt, and the second facing region being a region in the upper surface, which faces the head main body via the conveyance belt.

2. The inkjet recording apparatus according to claim 1, wherein the recessed portion in the first facing region includes a raised bottom portion having an upper surface of which height decreases toward the through hole.

3. The inkjet recording apparatus according to claim 1, wherein the plurality of recessed portions are formed in a groove shape whose longitudinal direction is the conveyance direction, and a width of the recessed portion in the width direction in the first facing region is narrower than a width of the recessed portion in the width direction in region.

4. The inkjet recording apparatus according to claim 1, wherein a flow path resistance of the through hole formed in the recessed portion included in the first facing region is larger than a flow path resistance of the through hole formed in the recessed portion included in the second facing region.

5. The inkjet recording apparatus according to claim 1, wherein an inclined portion is provided on a lower surface of the head end portion, the inclined portion being inclined so as to become higher as a distance from the head main body increases.

6. The inkjet recording apparatus according to claim 1, wherein a supply port that supplies a cleaning liquid to the cleaning member is provided on a lower surface of the head end portion.

7. An inkjet recording apparatus comprising:

an endless conveyance belt having a plurality of through holes and wound around a plurality of rollers;

a conveyance plate including a plurality of recessed portions formed in an upper surface thereof and a plurality of through holes formed in bottom portions of the plurality of recessed portions, the upper surface of the conveyance plate being in contact with an inner peripheral surface of the conveyance belt;

a suction unit that sucks air from the plurality of through holes of the conveyance plate to cause the conveyance belt to suck the sheet;

an inkjet head including a head main body having a lower surface on which a plurality of nozzles to eject an ink, arranged in a width direction of the conveyance belt intersecting the conveyance direction of the conveyance belt are formed, and a head end portion on which the nozzle to eject the ink is not formed, provided adjacently to one end or both ends of the head main body in the width direction, the inkjet head facing an upper surface of the conveyance plate via the conveyance belt; and a cleaning unit that removes ink attached to a lower surface of the head main body by bringing a cleaning member into contact with the lower surface of the head main body and sliding the cleaning member in the width direction, wherein a flow path resistance of the through hole formed in the recessed portion included in a first facing region is larger than a flow path resistance of the through hole formed in the recessed portion included in a second facing region, the first facing region being a region in the upper surface, which faces the head end portion via the conveyance belt, and the second facing region being a region in the upper surface, which faces the head main body via the conveyance belt.

* * * * *